US011613122B2

(12) United States Patent
Okui et al.

(10) Patent No.: US 11,613,122 B2
(45) Date of Patent: Mar. 28, 2023

(54) LIQUID EJECTING HEAD AND LIQUID EJECTING APPARATUS

(71) Applicant: Seiko Epson Corporation, Tokyo (JP)

(72) Inventors: Hiroaki Okui, Azumino (JP); Eiichiro Watanabe, Matsumoto (JP); Shun Katsuie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 31 days.

(21) Appl. No.: 17/335,230

(22) Filed: Jun. 1, 2021

(65) Prior Publication Data

US 2021/0370677 A1 Dec. 2, 2021

(30) Foreign Application Priority Data

| | | |
|---|---|---|
| Jun. 1, 2020 | (JP) | JP2020-095323 |
| Jun. 17, 2020 | (JP) | JP2020-104682 |
| Jun. 17, 2020 | (JP) | JP2020-104700 |
| Jul. 27, 2020 | (JP) | JP2020-126523 |
| Jul. 27, 2020 | (JP) | JP2020-126544 |
| Aug. 31, 2020 | (JP) | JP2020-145248 |
| Oct. 22, 2020 | (JP) | JP2020-177407 |
| Dec. 11, 2020 | (JP) | JP2020-205638 |

(51) Int. Cl.
*B41J 2/14* (2006.01)
*B41J 2/175* (2006.01)

(52) U.S. Cl.
CPC ..... *B41J 2/14233* (2013.01); *B41J 2/1433* (2013.01); *B41J 2/175* (2013.01); *B41J 2002/14362* (2013.01)

(58) Field of Classification Search
CPC ..... B41J 2/14233; B41J 2/1433; B41J 2/175
See application file for complete search history.

(56) References Cited

U.S. PATENT DOCUMENTS

| | | | | |
|---|---|---|---|---|
| 2008/0150986 | A1* | 6/2008 | Ikeda | B41J 2/155 347/42 |
| 2010/0214359 | A1 | 8/2010 | Essen et al. | |
| 2017/0282553 | A1 | 10/2017 | Hayashi et al. | |
| 2017/0282562 | A1* | 10/2017 | Mizuno | B41J 2/145 |
| 2020/0079086 | A1* | 3/2020 | Asai | B41J 2/14024 |

FOREIGN PATENT DOCUMENTS

| | | |
|---|---|---|
| JP | 2014-166755 | 9/2014 |
| JP | 2015-030181 | 2/2015 |
| JP | 2016-055476 | 4/2016 |
| JP | 2017-177675 | 10/2017 |

* cited by examiner

*Primary Examiner* — Jason S Uhlenhake
(74) *Attorney, Agent, or Firm* — Workman Nydegger

(57) ABSTRACT

A liquid ejecting head that has an ejection surface configured to eject a liquid includes a plurality of head chips that are long in a first direction. The plurality of head chips are arranged inside a virtual parallelogram including a first virtual side and a second virtual side that are in contact with at least one of the plurality of head chips and that extend in the first direction, and a third virtual side and a fourth virtual side that are in contact with at least one of the plurality of head chips and that extend in a second direction intersecting the first direction, and the ejection surface is not overlapped with an acute-angled portion of the virtual parallelogram when the ejection surface is viewed in a normal direction of the ejection surface.

20 Claims, 22 Drawing Sheets

LIQUID EJECTING HEAD AND LIQUID EJECTING APPARATUS

The present application is based on, and claims priority from JP Application Serial Number 2020-205638, filed Dec. 11, 2020, JP Application Serial Number 2020-095323, filed Jun. 1, 2020, JP Application Serial Number 2020-104700, filed Jun. 17, 2020, JP Application Serial Number 2020-104682, filed Jun. 17, 2020, JP Application Serial Number 2020-126523, filed Jul. 27, 2020, JP Application Serial Number 2020-126544, filed Jul. 27, 2020, JP Application Serial Number 2020-145248, filed Aug. 31, 2020, and JP Application Serial Number 2020-177407, filed Oct. 22, 2020, the disclosures of which are hereby incorporated by reference herein in their entirety.

BACKGROUND

1. Technical Field

The present disclosure relates to a liquid ejecting head and a liquid ejecting apparatus.

2. Related Art

In the related art, as represented by an ink jet printer, a liquid ejecting apparatus having a liquid ejecting head for ejecting a liquid such as ink has been known. For example, JP-A-2016-55476 discloses a plurality of head chips having nozzle rows arranged obliquely with respect to a transport direction of a medium such as printing paper. Liquid ejecting heads having the plurality of head chips are arranged in a width direction of the medium to form a line head.

When the area of the region where the head chip is not arranged increases on an ejection surface of the liquid ejecting head, the size of the liquid ejecting head becomes large. Further, when the plurality of liquid ejecting heads are arranged side by side to form a line head, it is likely that the size of the line head becomes large.

SUMMARY

According to an aspect of the present disclosure, there is provided a liquid ejecting head that has an ejection surface for ejecting a liquid, the liquid ejecting head including a plurality of head chips that are long in a first direction, in which the plurality of head chips are arranged inside a virtual parallelogram including a first virtual side and a second virtual side that are in contact with at least one of the plurality of head chips in the first direction and a third virtual side and a fourth virtual side that are in contact with at least one of the plurality of head chips in a second direction intersecting the first direction, and the ejection surface is not overlapped with acute-angled portions of the virtual parallelogram when the ejection surface is viewed in a normal direction of the ejection surface.

According to another aspect of the present disclosure, there is provided a liquid ejecting apparatus including the liquid ejecting head of the above-mentioned aspect and a liquid storage portion that stores a liquid supplied to the liquid ejecting head.

DESCRIPTION OF EXEMPLARY EMBODIMENTS

Hereinafter, embodiments for carrying out the present disclosure will be described with reference to the drawings. However, in each drawing, the dimensions and scale of each part are appropriately different from the actual ones. Further, since embodiments described below are preferred specific examples of the present disclosure, various technically preferable limitations are added; however, the scope of the present disclosure is not limited to these forms unless otherwise stated to limit the present disclosure in the following description.

In the following description, three directions intersecting each other will be described as an X-axis direction, a Y-axis direction, and a Z-axis direction. The X-axis direction includes an X1 direction and an X2 direction, which are directions opposite to each other. The X-axis direction is an example of a third direction. The Y-axis direction includes a Y1 direction and a Y2 direction, which are directions opposite to each other. The Y-axis direction is an example of a fourth direction. The Z-axis direction includes a Z1 direction and a Z2 direction, which are directions opposite to each other. The Z1 direction is a downward direction, and the Z2 direction is an upward direction. Also, in the present specification, "upper" and "lower" are used. "Upper" and "lower" correspond to "upper" and "lower" in the normal use state of a liquid ejecting apparatus 1A.

The Z-axis direction is a direction along a vertical direction. The X-axis direction, the Y-axis direction, and the Z-axis direction are typically orthogonal to each other, but are not limited thereto, and may intersect at an angle in a range of 80° or more and 100° or less, for example. The Z-axis direction does not have to be along the vertical direction.

Figure 1:
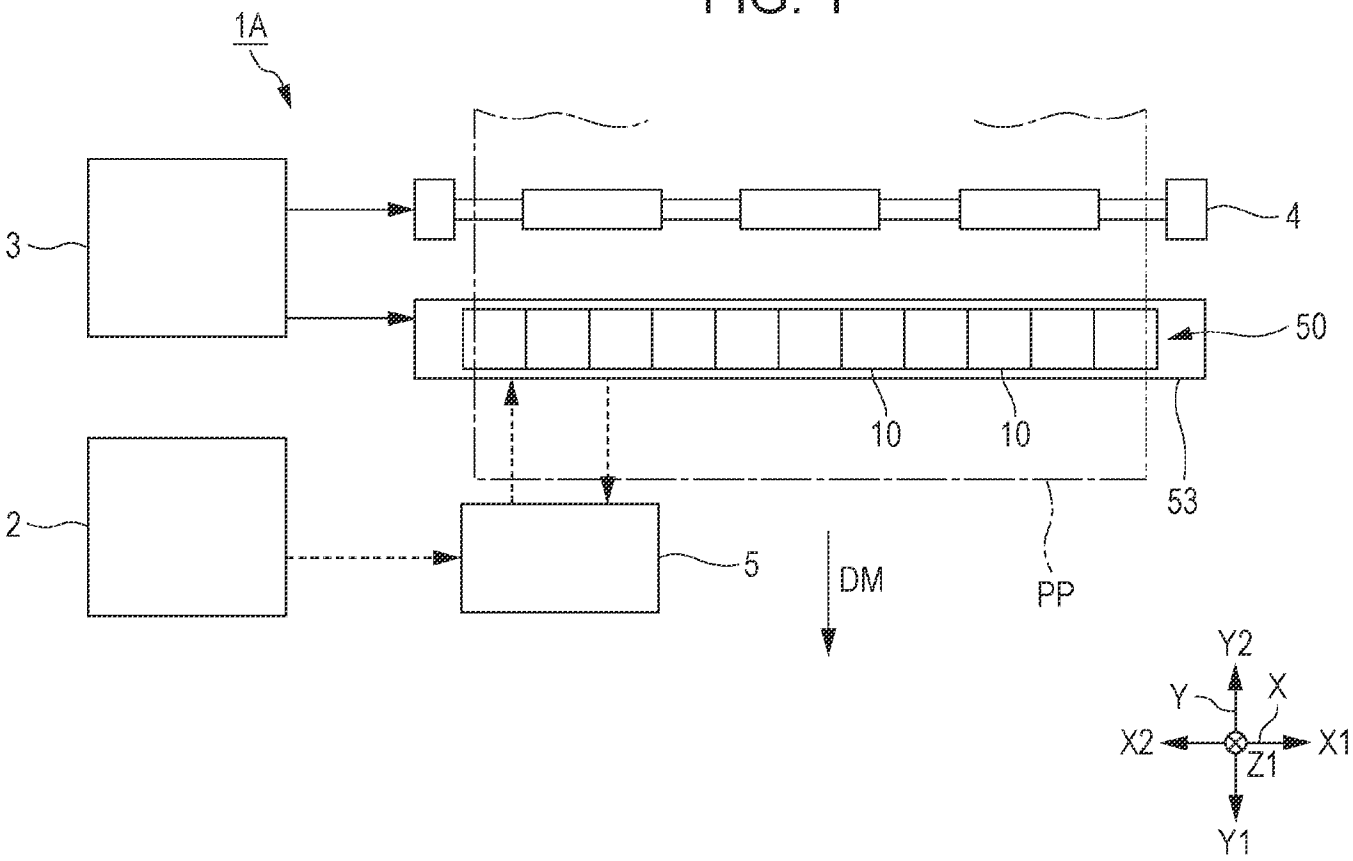
FIG. 1 is a schematic view showing a configuration example of a liquid ejecting apparatus according to a first embodiment.

FIG. 1 is a schematic view showing a configuration example of the liquid ejecting apparatus 1A according to a first embodiment. The liquid ejecting apparatus 1A is an ink jet-type printing apparatus that ejects ink, which is an example of a "liquid", as droplets onto a medium PP. The liquid ejecting apparatus 1A of the present embodiment is a so-called line-type printing apparatus in which a plurality of nozzles for ejecting ink are distributed over the entire range in the width direction of the medium PP. The medium PP is typically printing paper. The medium PP is not limited to printing paper, and may be a print target of any material such as a resin film or cloth.

As shown in FIG. 1, the liquid ejecting apparatus 1A includes a liquid container 2 for storing ink. Specific examples of the liquid container 2 include a cartridge that can be attached to and detached from the liquid ejecting apparatus 1A, a bag-shaped ink pack made of a flexible film, and an ink tank that can be refilled with ink. Any type of ink may be stored in the liquid container 2. The liquid container 2 is an example of a liquid storage portion.

Although not shown, the liquid container 2 includes a first liquid container and a second liquid container. A first ink is stored in the first liquid container. A second ink of a type different from that of the first ink is stored in the second liquid container. For example, the first ink and the second ink are inks of different colors from each other. The first ink and the second ink may be the same type of ink.

The liquid ejecting apparatus 1A includes a control unit 3, a medium transport mechanism 4, a circulation mechanism 5, and a plurality of liquid ejecting heads 10. The control unit 3 controls the operation of each element of the liquid ejecting apparatus 1A. The control unit 3 includes, for example, a processing circuit such as a central processing unit (CPU) or a field programmable gate array (FPGA), and a storage circuit such as a semiconductor memory. Various programs and various data are stored in the storage circuit. The processing circuit performs out various controls by executing the program and appropriately using the data.

The medium transport mechanism 4 is controlled by the control unit 3 and transports the medium PP in a transport direction DM. The transport direction DM is, for example, the Y1 direction. The transport direction DM is not limited to the Y1 direction, and may be the Y2 direction or any other direction. The medium transport mechanism 4 includes a transport roller that is long in the X-axis direction and a motor for rotating the transport roller. The medium transport mechanism 4 is not limited to a configuration using the transport roller, and may have a configuration using, for example, a drum or an endless belt by which the medium PP is transported in a state of being attracted to the outer peripheral surface by electrostatic force or the like.

The liquid ejecting head 10 is controlled by the control unit 3 and ejects ink supplied from the liquid container 2 via the circulation mechanism 5 from each of the plurality of nozzles to the medium PP. The plurality of liquid ejecting heads 10 are arranged in the X-axis direction to form a line head 50.

The ink stored in the liquid container 2 is supplied to the liquid ejecting heads 10 via the circulation mechanism 5. The circulation mechanism 5 supplies ink to the liquid ejecting heads 10 and collects the ink discharged from the liquid ejecting heads 10. The circulation mechanism 5 supplies the collected ink to the liquid ejecting heads 10 again. The circulation mechanism 5 includes a flow path for supplying ink to the liquid ejecting heads 10, a flow path for collecting the ink discharged from the liquid ejecting heads 10, a sub tank for storing the collected ink, and ink, a pump for transferring ink, and the like.

Figure 2:
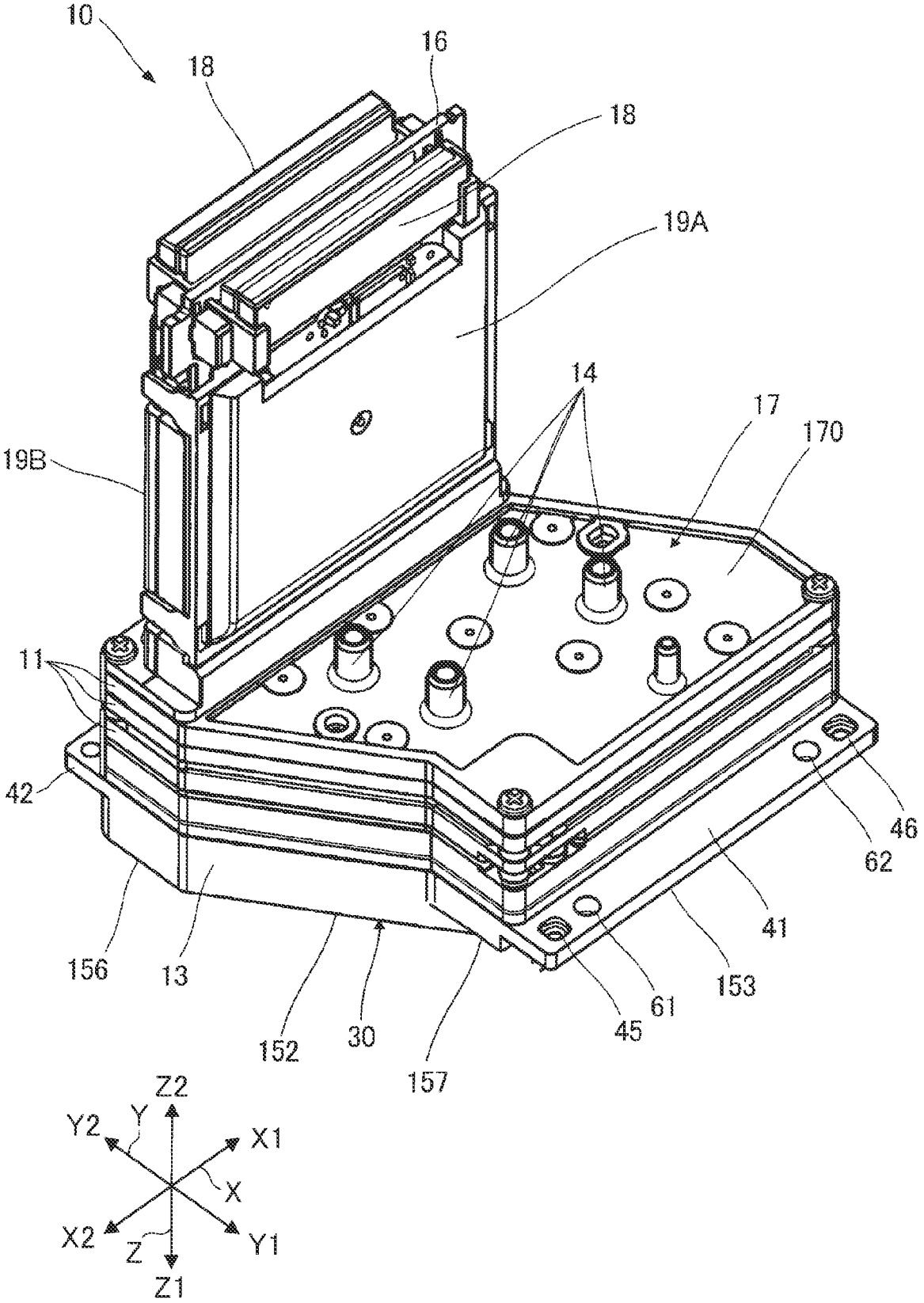
FIG. 2 is a perspective view of a liquid ejecting head.
Figure 3:
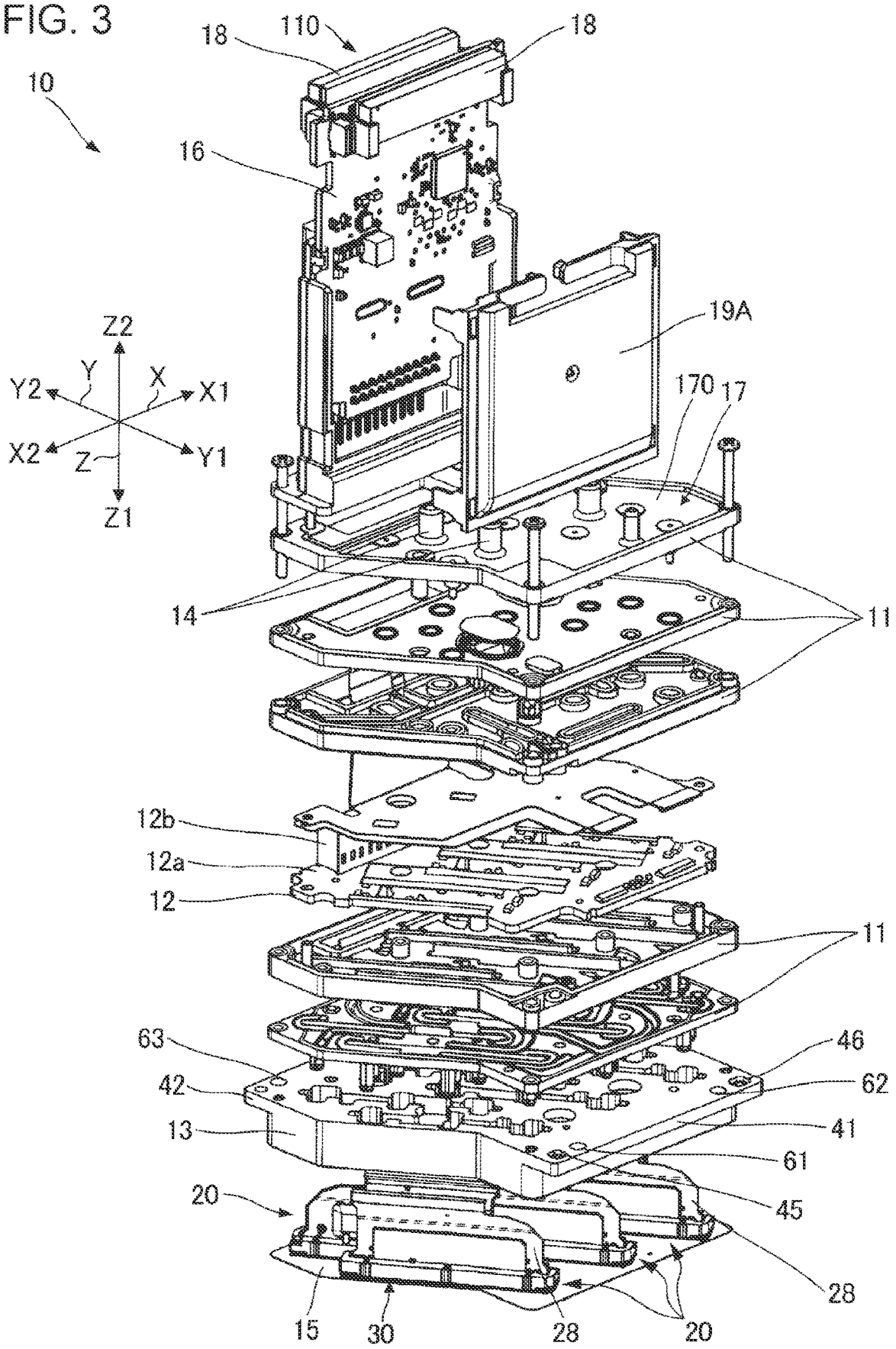
FIG. 3 is an exploded perspective view of the liquid ejecting head.
Figure 4:
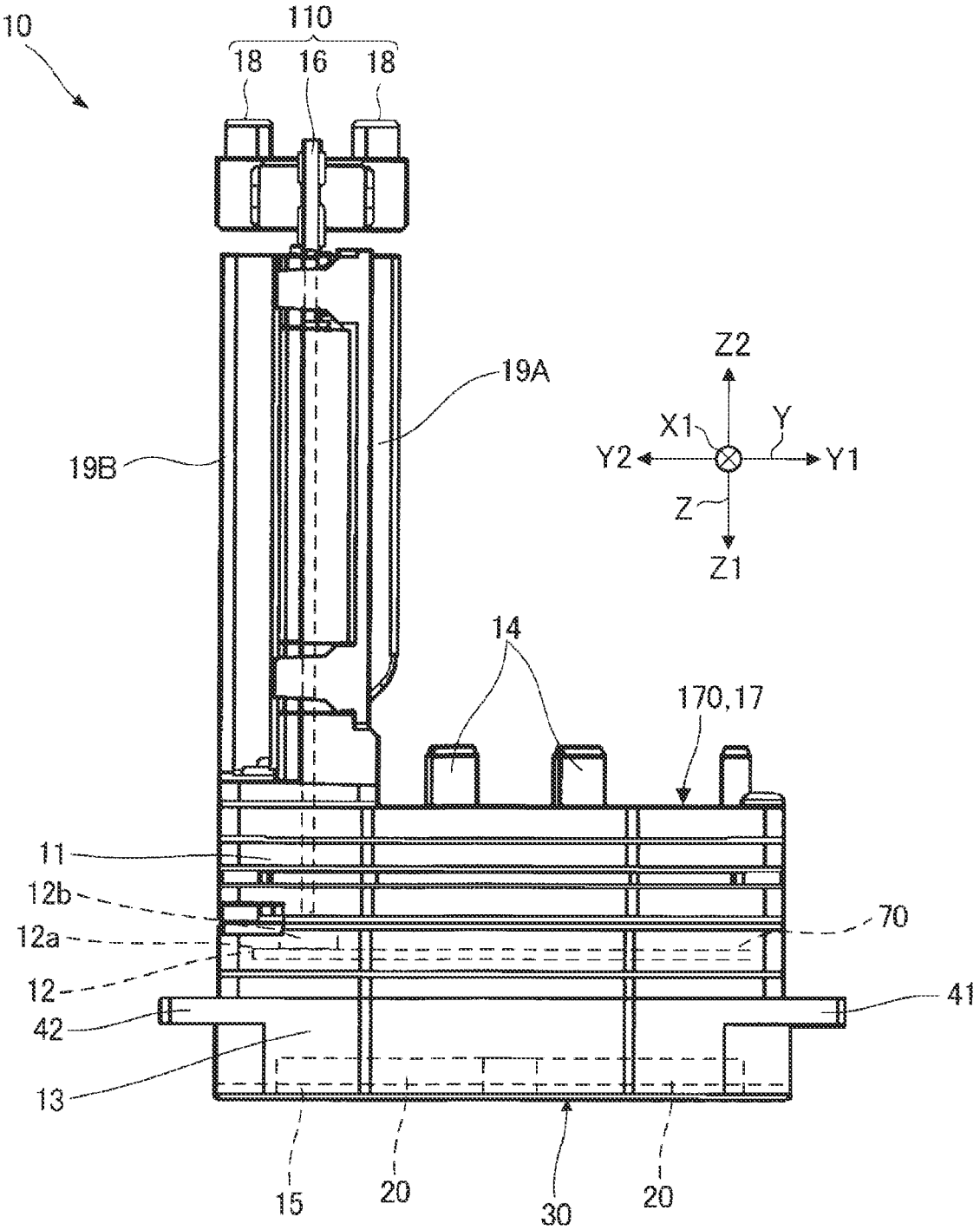
FIG. 4 is a side view of the liquid ejecting head.
Figure 5:
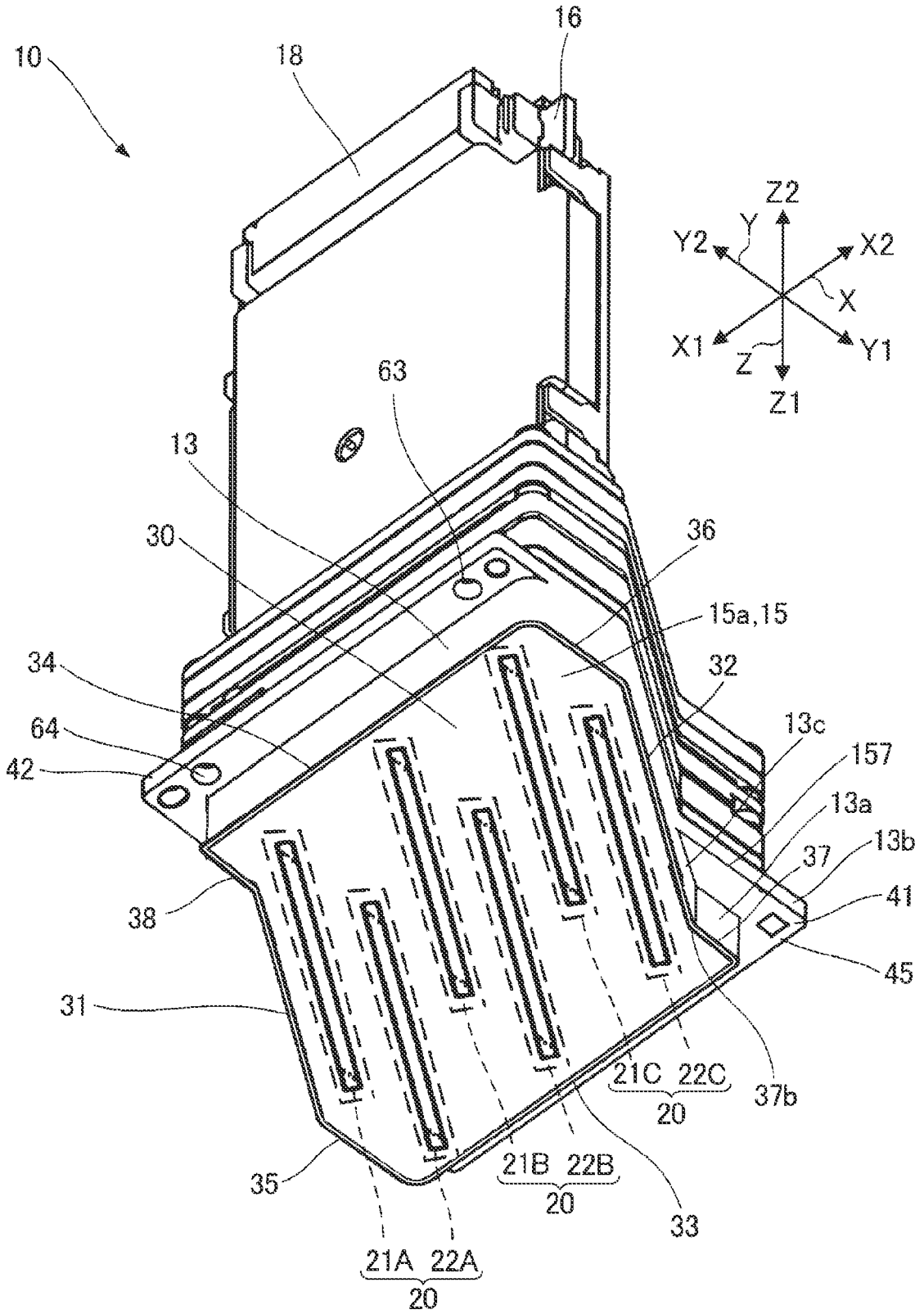
FIG. 5 is a perspective view of the liquid ejecting head showing an ejection surface.
Figure 6:
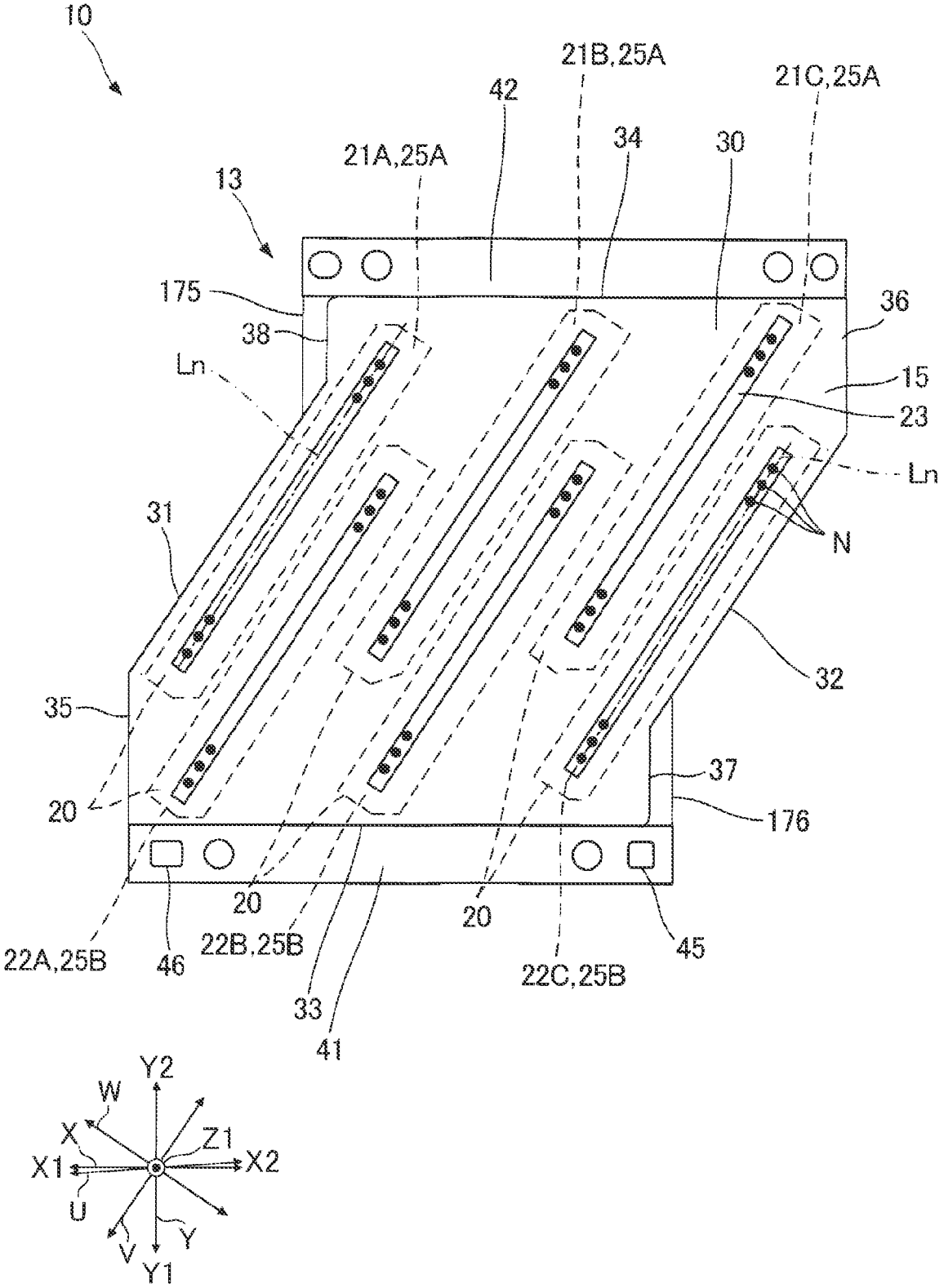
FIG. 6 is a bottom view of the liquid ejecting head showing the ejection surface, in which a plurality of head chip groups are shown.

Next, the liquid ejecting head 10 will be described with reference to FIGS. 2 to 6. FIG. 2 is a perspective view of the liquid ejecting head 10. FIG. 3 is an exploded perspective view of the liquid ejecting head 10. FIG. 4 is a side view of the liquid ejecting head 10. FIG. 5 is a perspective view of the liquid ejecting head 10 showing an ejection surface 30. FIG. 6 is a bottom view of the liquid ejecting head 10 showing the ejection surface 30. In FIG. 5, the liquid ejecting head 10 is shown from diagonally below. As shown in FIG. 2, the liquid ejecting head 10 includes a flow path structure 11 and a holder 13. As shown in FIG. 3, the liquid ejecting head 10 has a plurality of head chips 20.

A flow path through which ink flows is formed inside the flow path structure 11 shown in FIGS. 2 and 3. The flow path communicates with the circulation mechanism 5 and the plurality of head chips 20. Inside the liquid ejecting head 10, a flow path for supplying ink to the plurality of head chips 20 and a flow path for collecting ink discharged from the head chips 20 are formed. The flow path structure 11 includes a plurality of flow path substrates that are plate-shaped members.

In the flow path substrate, at least one of a recess or an opening for forming the flow path and a pipe protruding from the flow path substrate in the Z-axis direction is formed. The top plate 17, which is a flow path substrate stacked on the top in the Z2 direction among the plurality of flow path substrates of the flow path structure 11, has an upper surface 170 which is a surface facing the side opposite to the ejection surface 30. The top plate 17 is provided with a flow path pipe 14 that protrudes from the upper surface 170 in the Z2 direction and is coupled with an external flow path of the liquid ejecting head 10.

As shown in FIGS. 3 and 4, the liquid ejecting head 10 includes a wiring substrate 12. The wiring substrate 12 is a mounting component for electrically coupling the plurality of head chips 20 and a relay substrate 16 to be described later. The wiring substrate 12 is, for example, a rigid wiring substrate. The wiring substrate 12 is disposed in the Z2 direction with respect to the holder 13. Further, in the present embodiment, the wiring substrate 12 is disposed between a plurality of flow path substrates constituting the flow path structures 11 stacked in the Z-axis direction.

A connector 12*b* is installed on the upper surface 12*a*, which is a surface of the wiring substrate 12 facing the Z2 direction. The connector 12*b* is a coupling component coupled to the relay substrate 16. The wiring substrate 12 is coupled to a drive element that is electrically coupled to the wiring member 28 of the head chip 20. The wiring member 28 is, for example, a flexible printed circuit (FPC), a chip on film (COF), or the like.

The relay substrate 16 extends from the connector 12*b* in the Z2 direction. The relay substrate 16 passes through a part of the flow path structure 11 in the Z2 direction and projects upward. The plate thickness direction of the relay substrate 16 is a direction along the Y-axis direction. A plurality of connectors 18 are provided at the end portion of the relay substrate 16 in the Z2 direction. The connectors 18 are disposed on both sides in the Y-axis direction. Each of the connectors 18 has a plurality of coupling terminals (not shown) therein. The coupling terminal is a terminal for electrically coupling to the outside of the liquid ejecting head 10. The plurality of coupling terminals are arranged side by side in the X-axis direction.

The relay substrate 16 and the connector 18 are included in an electrical coupling portion 110 for electrically coupling the liquid ejecting head 10 to the outside. In the relay substrate 16, wiring for electrically coupling the connector 18 and the wiring substrate 12 is formed. The relay substrate 16 is, for example, a rigid wiring substrate. The arrangement of the connector 18 when the liquid ejecting head 10 is viewed in the Z-axis direction will be described later.

As shown in FIG. 4, a cover 19A and a cover 19B are provided on both sides of the relay substrate 16 in the Y-axis direction. The cover 19A covers the surface of the relay substrate 16 in the Y1 direction. The cover 19B covers the surface of the relay substrate 16 in the Y2 direction. The cover 19A and the cover 19B may include a portion that covers the end surface of the relay substrate 16 in the X-axis direction.

The holder 13 is positioned below the wiring substrate 12. The holder 13 has a predetermined thickness in the Z-axis direction. The holder 13 holds a fixing plate 15 and the plurality of head chips 20. In the holder 13, openings or recesses for accommodating the head chips 20 are formed. The holder 13 may include a plurality of plate-shaped members. The holder 13 is made of, for example, stainless steel. The material of the holder 13 is not limited to stainless steel, and may be other materials such as metal and resin.

In the holder 13, flange portions 41 and 42 projecting out beyond both sides in the Y-axis direction are formed. The flange portions 41 and 42 project to the opposite sides. The flange portion 41 projects in the Y1 direction, and the flange portion 42 projects in the Y2 direction. The flange portions 41 and 42 will be described later.

The fixing plate 15 shown in FIGS. 5 and 6 is a plate-shaped member for fixing the plurality of head chips 20 to the holder 13. The fixing plate 15 constitutes the bottom surface of the liquid ejecting head 10. The lower surface 15*a* of the fixing plate 15 is a surface facing the medium PP and constitutes a part of the ejection surface 30. In the fixing plate 15, an opening for exposing the nozzle plate 23 of the head chips 20 is formed. As shown in FIG. 6, a plurality of nozzles N are formed on the nozzle plate 23. The arrangement of the plurality of head chips 20 and the shape of the ejection surface 30 will be described later.

The head chip 20 includes a mechanism (not shown) for ejecting ink from a nozzle. The head chip 20 includes a flow path through which ink flows, a pressure generating chamber communicating with the nozzle, a vibration plate for changing the pressure of ink in the pressure generating chamber, a piezoelectric element for vibrating the vibration plate, upper and lower electrodes for driving the piezoelectric element, the above-mentioned wiring member 80 electrically coupled to the upper electrode and the lower electrode, and the like. The outer shape of the head chip 20 has a rectangular shape when viewed in the normal direction of the ejection surface 30. The rectangular shape includes a substantially rectangular shape. The head chip 20 may have a substantially rectangular shape by cutting at least a part of the corners of the rectangle, or may have a substantially rectangular shape in which a notch or a protrusion is formed on at least one side of the rectangle.

When the liquid ejecting head 10 is viewed in the Z2 direction, which is the normal direction of the ejection surface 30, the lower surface 15*a* of the fixing plate 15, the nozzle plate 23, and the flange portions 41 and 42 can be seen. The ejection surface 30 includes the fixing plate 15 and the nozzle plate 23. As shown in FIG. 4, the ejection surface 30 and the flange portions 41 and 42 are disposed at different positions in the Z-axis direction.

Next, the arrangement of the plurality of head chips 20 when the ejection surface 30 is viewed in the Z-axis direction will be described with reference to FIG. 6. In FIG. 6, the outer shape of the head chip 20 is shown by a broken line, and the nozzle row Ln is schematically shown by a dashed line. As shown in FIG. 6, the longitudinal direction of the plurality of head chips 20 is the V direction inclined with respect to the X-axis direction and the Y-axis direction when the ejection surface 30 is viewed in the Z-axis direction. The V direction is an example of the first direction.

The head chip 20 has a nozzle plate 23 in which the plurality of nozzles N are formed. The nozzle N is a through-hole penetrating the nozzle plate 23 in the plate thickness direction. The plate thickness direction of the nozzle plate 23 is a direction along the Z-axis direction. The plurality of nozzles N are arranged in the longitudinal direction of the head chip 20 to form the nozzle row Ln. The plurality of nozzles N included in the same nozzle row Ln are disposed on the same straight line. The nozzle row Ln extends in the V direction.

"the longitudinal direction of the head chip 20 is the V direction" may refer to "the outer shape of the head chip 20 is long in the V direction", and also includes "the nozzle row Ln of the head chip 20 is in the V direction". Further, "the longitudinal direction of the head chip 20 is the V direction" refer to "when the outer shape of the head chip 20 when viewed in the normal direction of the ejection surface 30 is rectangular, the long side of the rectangle is in the V direction".

The plurality of head chips 20 constitute a plurality of chip groups 25A and 25B. The plurality of chip groups 25A and 25B are arranged in this order in the Y1 direction. In the present specification, when the head chips 21A to 21C and 22A to 22C, which will be described later, are not distinguished, they are referred to as the head chips 20.

The chip group 25A has head chips 21A, 21B, and 21C as a plurality of head chips 20. The head chips 21A, 21B, and 21C are arranged in the X2 direction in this order. Of the head chips 20 of the chip group 25A, the nozzle rows Ln of the adjacent head chips 20 partially overlap each other when viewed in the Y-axis direction. Therefore, the print width in the X-axis direction can be increased.

Further, most of the head chips 21A to 21C of the chip group 25A overlap each other when viewed in the X-axis direction. In the present embodiment, the head chip 21B is slightly offset from the adjacent head chip 21A in the Y2 direction, and the head chip 21C is slightly displaced from the adjacent head chip 21B in the Y2 direction; however, the head chips 21A to 21C of the chip group 25A do not have to be displaced from each other in the Y-axis direction.

The chip group 25B has head chips 22A, 22B, and 22C as a plurality of head chips 20. The positional relationship of the head chips 22A, 22B, and 22C included in the chip group 25B is the same as the positional relationship of the head chips 21A, 21B, and 21C included in the chip group 25A.

The chip group 25A and the chip group 25B substantially overlap each other when viewed in the Y-axis direction. The fact that the chip group 25A and the chip group 25B substantially overlap each other when viewed in the Y-axis direction means that, when viewed in the Y-axis direction, the head chip 21A disposed foremost in the X1 direction in the chip group 25A and the head chip 22A disposed foremost in the X1 direction in the chip group 25B are substantially overlapped, and the head chip 21C disposed foremost in the X2 direction in the chip group 25A and the head chip 22C disposed foremost in the X2 direction in the chip group 25B are substantially overlapped.

Incidentally, the fact that the two head chips 20 substantially overlap each other in the Y-axis direction means that, for example, the nozzle N positioned foremost in the X1 direction in the head chip 21A and the nozzle N positioned foremost in the X1 direction in the head chip 22A are at the same position with respect to the X-axis direction, or within half of the pitch in the X-axis direction at the adjacent nozzles N of the head chip 20. With such a configuration, high image quality can be achieved by making the type of the liquid ejected from the chip group 25A and the type of the liquid ejected from the chip group 25B the same, and multi-coloring can be achieved by changing the type of liquid.

Further, since the chip group 25A and the chip group 25B partially overlap each other when viewed in the X-axis direction, the ejection surface 30 can be miniaturized in the Y-axis direction.

Figure 7:
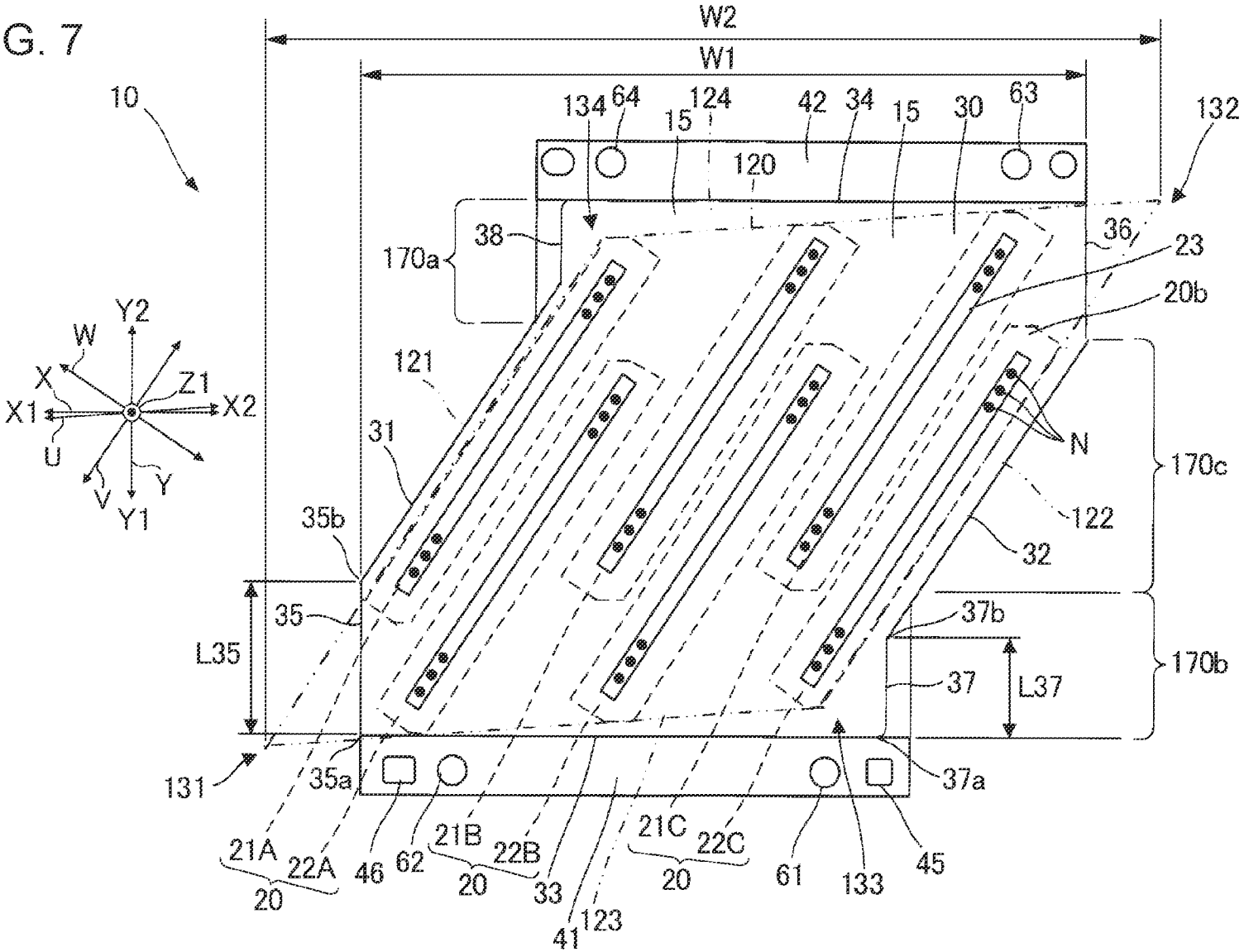
FIG. 7 is a bottom view of the liquid ejecting head showing the ejection surface, in which a virtual parallelogram corresponding to an arrangement of a plurality of head chips is shown.

Next, a positional relationship between the plurality of head chips 20 and a virtual parallelogram 120 when the ejection surface 30 is viewed in the Z-axis direction will be described with reference to FIG. 7. In FIG. 7, the outer shape of the head chip 20 is indicated by a broken line, and the virtual parallelogram 120 is indicated by a double-dashed line. The virtual parallelogram 120 can be set based on the arrangement of the plurality of head chips 20. The virtual parallelogram 120 is used to illustrate the shape of the ejection surface 30. The virtual parallelogram 120 will be first described, and then the shape of the ejection surface 30 will be described.

The virtual parallelogram 120 has virtual sides 121 to 124. The virtual side 121 is an example of the first virtual side, and the virtual side 122 is an example of the second virtual side. The virtual side 123 is an example of the third virtual side, and the virtual side 124 is an example of the fourth virtual side. The virtual sides 121 and 122 are separated from each other in the X-axis direction and extend in the V direction. The virtual sides 123 and 124 are separated from each other in the Y-axis direction and extend in the U direction. The U direction is inclined with respect to the X-axis direction, the Y-axis direction, and the V direction when the ejection surface 30 is viewed in the Z-axis direction. The U direction is inclined by, for example, 5° with respect to the X-axis direction when the ejection surface 30 is viewed in the Z-axis direction. The U direction is an example of the second direction. The U direction may not be inclined with respect to the X-axis direction when the ejection surface 30 is viewed in the Z-axis direction; in other words, the U direction may be the X-axis direction.

The virtual parallelogram 120 has acute-angled portions 131 and 132 and obtuse-angled portions 133 and 134. The virtual sides 121 and 123 form the acute-angled portion 131. The acute-angled portion 131 is an example of the first acute-angled portion. The virtual sides 122 and 124 form an acute-angled portion 132. The virtual sides 122 and 123 form the obtuse-angled portion 133. The virtual sides 122 and 124 form the obtuse-angled portion 134. All head chips 20 are located inside the virtual parallelogram 120 when viewed in the Z-axis direction.

At least one head chip 20 is inscribed in the virtual side 121. The fact that the head chips 20 are inscribed in the virtual sides 121 to 124 means that the head chips 20 disposed inside the virtual parallelogram 120 is inscribed on the virtual sides 121 to 124. In the present embodiment, only one head chip 20 is inscribed in the virtual side 121. Only the head chip 21A is inscribed in the virtual side 121.

At least one head chip 20 is inscribed in the virtual side 122. In the present embodiment, only one head chip 20 is inscribed in the virtual side 122. Only the head chip 22C is inscribed in the virtual side 122. The head chip 22C inscribed in the virtual side 122 is different from the head chip 21A inscribed in the virtual side 121.

At least one head chip 20 is inscribed in the virtual side 123. In the present embodiment, a plurality of head chips 20 are inscribed in the virtual side 123. For example, the three head chips 22A to 22C included in the chip group 25B are inscribed in the virtual side 123.

At least one head chip 20 is inscribed in the virtual side 124. In the present embodiment, a plurality of head chips 20 are inscribed in the virtual side 124. For example, three head chips 21A to 21C included in the chip group 25A are inscribed in the virtual side 124.

As described above, in the present embodiment, each of the head chips 20 included in the liquid ejecting head 10 is inscribed in any of the virtual sides 121 to 124 of the virtual parallelogram 120 when viewed in the Z-axis direction.

Figure 8:
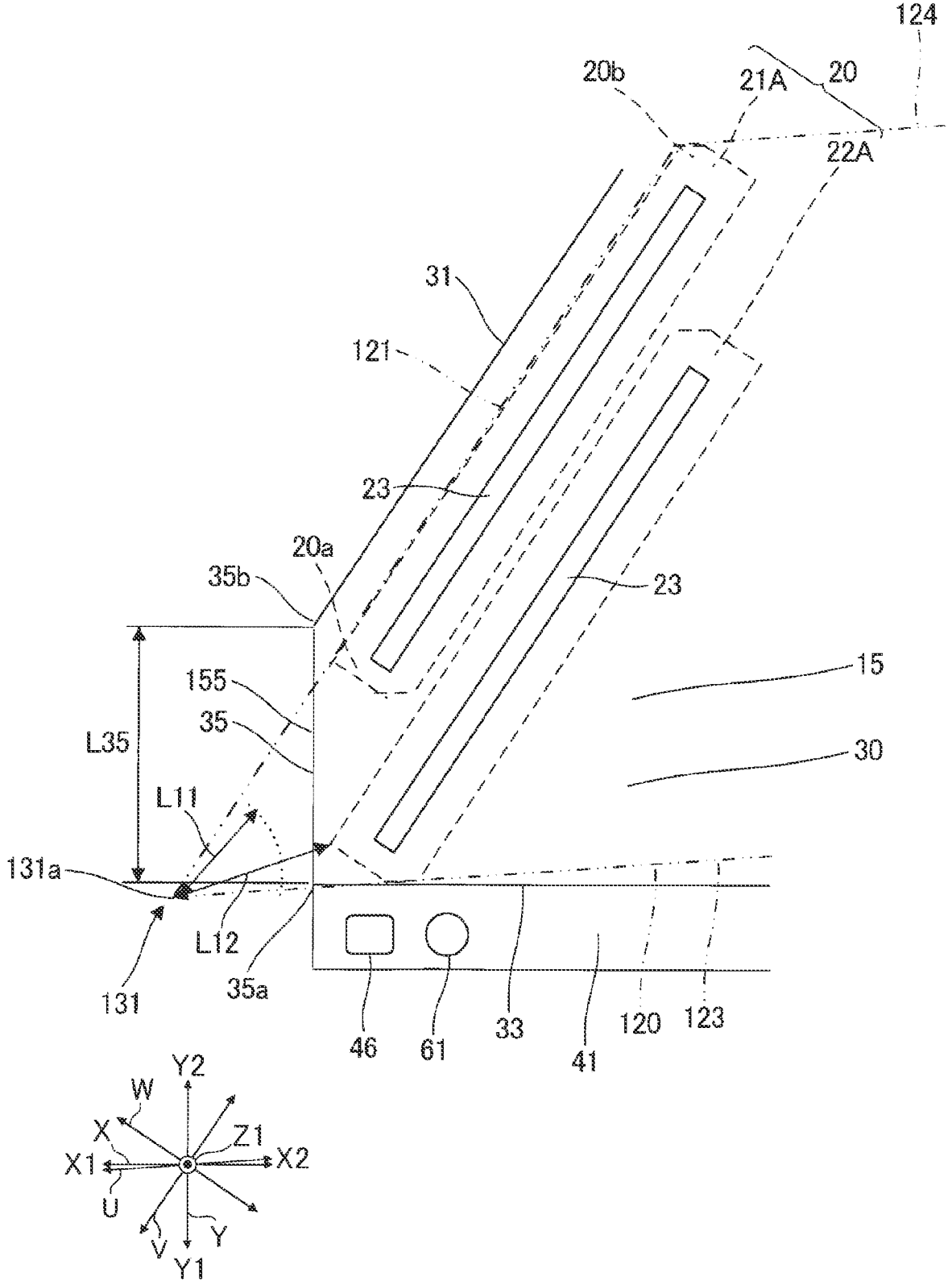
FIG. 8 is a bottom view showing a part of an ejection surface, in which an acute-angled portion of a virtual parallelogram is shown.

FIG. 8 is a bottom view showing a part of the ejection surface 30, in which an acute-angled portion 131 of the virtual parallelogram 120 is shown. In FIG. 8, the outer shape of the head chip 20 is indicated by a broken line, the virtual parallelogram 120 is indicated by a double-dashed line, and the region of the acute-angled portion 131 is indicated by a dotted line. As shown in FIG. 8, the plurality of head chips 20 includes the head chip 21A inscribed in the virtual side 121 at a position closest to the acute-angled portion 131 and the head chip 22A inscribed in the virtual side 123 at a position closest to the acute-angled portion 131. The head chip 21A is an example of the first head chip, and the head chip 22A is an example of the second head chip. The head chip 21A inscribed in the virtual side 121 at a position closest to the acute-angled portion 131 is different from the head chip 22A inscribed in the virtual side 123 at a position closest to the acute-angled portion 131. The head chip 21A inscribed in the virtual side 121 is not inscribed in the virtual side 123. The head chip 22A inscribed in the virtual side 123 is not inscribed in the virtual side 121.

The plurality of head chips 20 include the head chip 21C inscribed in the virtual side 124 at a position closest to the acute-angled portion 132, and the head chip 22C inscribed in the virtual side 122 at a position closest to the acute-angled portion 132. The head chip 21C inscribed in the virtual side 124 at a position closest to the acute-angled portion 132 is different from the head chip 22C inscribed in the virtual side 122 at a position closest to the acute-angled portion 132. The head chip 21C inscribed in the virtual side 124 is not inscribed in the virtual side 122. The head chip 22C inscribed in the virtual side 122 is not inscribed in the virtual side 124.

The plurality of head chips 20 include the head chip 21A inscribed in both virtual sides 121 and 124. The plurality of head chips 20 include the head chip 22C inscribed in both virtual sides 122 and 123.

Next, the outer shape of the ejection surface 30 when viewed in the Z-axis direction will be described with reference to FIG. 7. The ejection surface 30 has edges 31 to 38. The edges 31 to 38 form the outer shape of the ejection surface 30. The edge 31 extends in the virtual side 121 of the virtual parallelogram 120. The edge 32 extends in the virtual side 122. The edges 31 and 32 extend linearly in the V direction.

The edges 33 and 34 form both end portions of the ejection surface 30 in the Y-axis direction, respectively. The edges 33 and 34 are separated from each other in the Y-axis direction and extend linearly in the X-axis direction. The edge 33 forms the end portion of the ejection surface 30 in the Y1 direction, and the edge 34 forms the end portion of the ejection surface 30 in the Y2 direction.

The edge 35 forms the end portion of the ejection surface 30 in the X1 direction. The edge 35 are in contact with the edge 31 and the edge 33, in the Y-axis direction. The edge 35 extends linearly in the Y-axis direction between the acute-angled portion 131 of the virtual parallelogram 120 and the head chip 20 closest to the acute-angled portion 131 in the X-axis direction. The edge 35 intersects the virtual sides 121 and 123.

The edge 35 is overlapped with at least one of the plurality of head chips 20 that are not in contact with the virtual side 123 when viewed in the X-axis direction. The edge 35 is overlapped with at least one of the plurality of head chips 20 that are in contact with the virtual side 124 when viewed in the X-axis direction. The edge 35 is overlapped with the end portion 20*a* of the head chip 21A when viewed in the X-axis direction. The head chip 21A is in contact with the virtual side 124 and not in contact with the virtual side 123. The end portion 20*a* is an end portion that is closest to the edge 33 in both end portions 20*a* and 20*b* of the head chip 20 in the longitudinal direction.

The edge 36 forms the end portion of the ejection surface 30 in the X2 direction. The edge 36 is in contact with the edge 32 and the edge 34 in the Y-axis direction. The edge 36 extends linearly in the Y-axis direction between the acute-angled portion 132 of the virtual parallelogram 120 and the head chip 20 closest to the acute-angled portion 132 in the X-axis direction. The edge 36 intersects the virtual sides 122 and 124.

The edge 36 is overlapped with at least one of the plurality of head chips 20 that are not in contact with the virtual side 124 when viewed in the X-axis direction. The edge 36 is overlapped with at least one of the plurality of head chips 20 that are in contact with the virtual side 123 when viewed in the X-axis direction. The edge 36 is overlapped with the end portion 20*b* of the head chip 22C when viewed in the X-axis direction. The head chip 22C is in contact with the virtual side 123 and is not in contact with the virtual side 124. The end portion 20*b* is an end portion that is closest to the edge 34 in both end portions 20*a* and 20*b* of the head chip 20 in the longitudinal direction.

The edge 37 is the opposite side of the edge 35 in the X-axis direction and extends linearly in the Y-axis direction. The edge 37 is in contact with the edge 32 and the edge 33 in the Y-axis direction. The edge 37 is disposed outside the obtuse-angled portion 133 in the X-axis direction. The edge 37 is positioned outside the virtual parallelogram 120 in the X-axis direction and is not overlapped with the virtual parallelogram 120 in the Z-axis direction.

The edge 38 is the opposite side of the edge 36 in the X-axis direction and extends linearly in the Y-axis direction. The edge 38 is in contact with the edge 31 and the edge 34 in the Y-axis direction. The edge 38 is disposed outside the obtuse-angled portion 133 in the X-axis direction. The edge 38 is positioned outside the virtual parallelogram 120 in the X-axis direction and is not overlapped with the virtual parallelogram 120 in the Z-axis direction.

Next, a positional relationship between the edges 35 and 36 and the acute-angled portions 131 and 132 of the virtual parallelogram 120 will be described with reference to FIG. 8. As shown in FIG. 8, the ejection surface 30 is not overlapped with the acute-angled portion 131 of the virtual parallelogram 120 when viewed in the Z-axis direction. The edge 35 is present at a position closer to the center of the virtual parallelogram 120 than the acute-angled portion 131 in the X-axis direction. The center of the virtual parallelogram 120 is the intersection of the diagonal lines of the virtual parallelogram 120. The edge 35 is not outside the acute-angled portion 131 in the X-axis direction. The head chip 22A closest to the acute-angled portion 131 is not present within the range of the acute-angled portion 131.

The range of the acute-angled portion 131 can be within a predetermined length L11 from an apex 131*a* of the acute-angled portion 131, for example, as shown by the dotted line in FIG. 8. The predetermined length L11 may be, for example, 80% of a distance L12 from the apex 131*a* to the head chip 22A closest to the apex 131*a*. The predetermined length L11 may be, for example, 50% or more and 90% or less of the distance L12.

Similarly, the ejection surface 30 is not overlapped with the acute-angled portion 132. The edge 36 is present at a position closer to the center of the virtual parallelogram 120 than the acute-angled portion 132 in the X-axis direction. The head chip 21C closest to the acute-angled portion 132 is not present within the range of the acute-angled portion 132.

Figure 9:
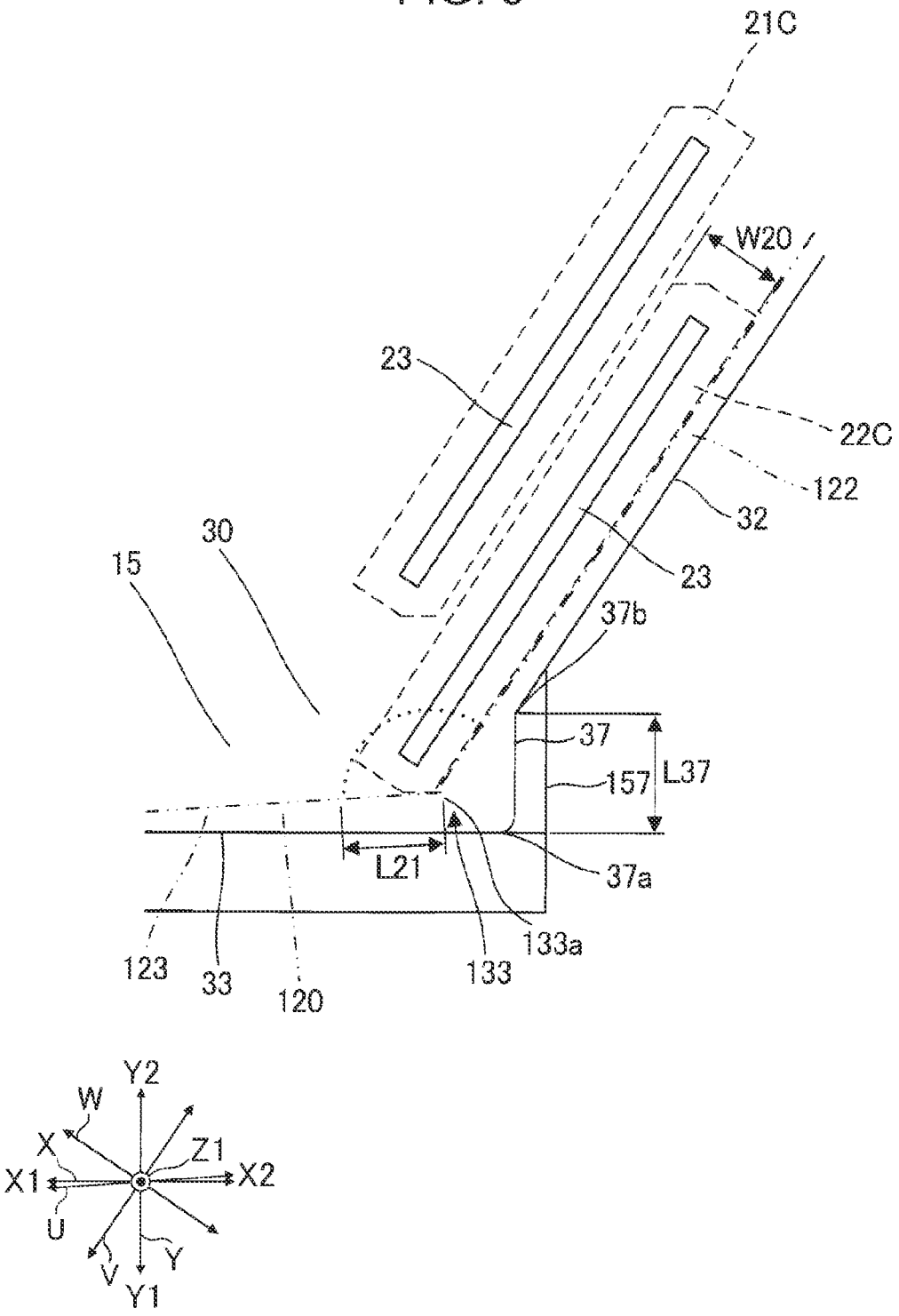
FIG. 9 is a bottom view showing a part of an ejection surface, in which an obtuse-angled portion of a virtual parallelogram is shown.

Next, a positional relationship between the edges 37 and 38 and the obtuse-angled portions 133 and 134 of the virtual parallelogram 120 will be described with reference to FIG. 9. FIG. 9 is a bottom view showing a part of the ejection surface 30, in which the obtuse-angled portion 133 of the virtual parallelogram 120 is shown. In FIG. 9, the outer shape of the head chip 20 is indicated by a broken line, the virtual parallelogram 120 is indicated by a double-dashed line, and the region of the obtuse-angled portion 133 is indicated by a dotted line. As shown in FIG. 9, the ejection surface 30 is overlapped with the entire region of the obtuse-angled portion 133 of the virtual parallelogram 120. The edge 37 is positioned outside the obtuse-angled portion 133 in the X-axis direction. The edge 33 is positioned outside the obtuse-angled portion 133 in the Y-axis direction. The ejection surface 30 extends to the outside of the obtuse-angled portion 133.

The range of the obtuse-angled portion 133 can be within a predetermined length L21 from an apex 133*a* of the obtuse-angled portion 133, for example, as shown by the dotted line in FIG. 9. A case where the ejection surface 30 extends over the entire range of the obtuse-angled portion 133 is regarded as being overlapped with the entire region of the obtuse-angled portion 133. The predetermined length L21 indicating the range of the obtuse-angled portion 133 may be, for example, the same length as the width W20 of the head chip 20. The predetermined length L21 may be 70% or more and 120% or less of the width W20 of the head chip 20. The predetermined length L21 indicating the range of the obtuse-angled portion 133 may be the same length as L11 indicating the range of the acute-angled portion 131.

The ejection surface 30 is also overlapped with the entire region of the obtuse-angled portion 134. The ejection surface 30 extends to the outside of the obtuse-angled portion 134, and the edge 38 is positioned outside the obtuse-angled portion 134 in the X-axis direction. The edge 34 is positioned outside the obtuse-angled portion 134 in the Y-axis direction. The predetermined length indicating the range of the obtuse-angled portion 134 is the same as the predetermined length L21 indicating the range of the obtuse-angled portion 133. The ejection surface 30 is overlapped with the entire region of both obtuse-angled portions 133 and 134 of the virtual parallelogram 120.

In the liquid ejecting head 10, the ejection surface 30 is not overlapped with the acute-angled portions 131 and 132 of the virtual parallelogram 120. The width W1 of the ejection surface 30 in the X-axis direction is shorter than the width W2 of the virtual parallelogram 120 in the X-axis direction. The width W1 is a distance between the edge 35 and the edge 36 in the X-axis direction. The width W2 is a distance between the acute-angled portions 131 and 132 of the virtual parallelogram 120 in the X-axis direction.

For example, when an ejection surface having an outer shape depending on the virtual parallelogram is set, the outer shape of the ejection surface is made larger in the X-axis direction. For the liquid ejecting head 10, the ejection surface 30 is not overlapped with the acute-angled portions 131 and 132 of the virtual parallelogram 120, and thus the region where the head chips 20 are not arranged is reduced. Since such the plurality of liquid ejecting heads 10 are arranged in the X-axis direction to form the line head 50, the length of the line head 50 in the longitudinal direction is shortened. As a result, the liquid ejecting apparatus 1A can be miniaturized.

Next, a length L35 of the edge 35 and a length L37 of the edge 37 will be described with reference to FIGS. 7 to 9. The length L37 of the edge 37 is shorter than the length L35 of the edge 35. The length L35 of the edge 35 is the distance from an end portion 35*a* to an end portion 35*b* in the Y-axis direction. The end portion 35*a* is an intersection of the edge 33 and the edge 35. The end portion 35*b* is an intersection of the edge 35 and the edge 31. The edge 35 is disposed at the same position as the edge 155 forming the outer shape of the holder 13 when viewed in the Z-axis direction.

The length L37 of the edge 37 is the distance from an end portion 37*a* to an end portion 37*b* in the Y-axis direction. The end portion 37*a* is an intersection of the edge 33 and the edge 37. The end portion 37*b* is an intersection of the edge 37 and the edge 32. The end portions 35*a* and 37*a* are located at the same position in the Y-axis direction. The end portion 35*b* is present at a position far from the edge 33 in the Y-axis direction as compared with the end portion 37*b*. As shown in FIG. 5, the edge 37 is positioned inside the edge 157 forming the outer shape of the holder 13 when viewed in the Z-axis direction.

Figure 10:
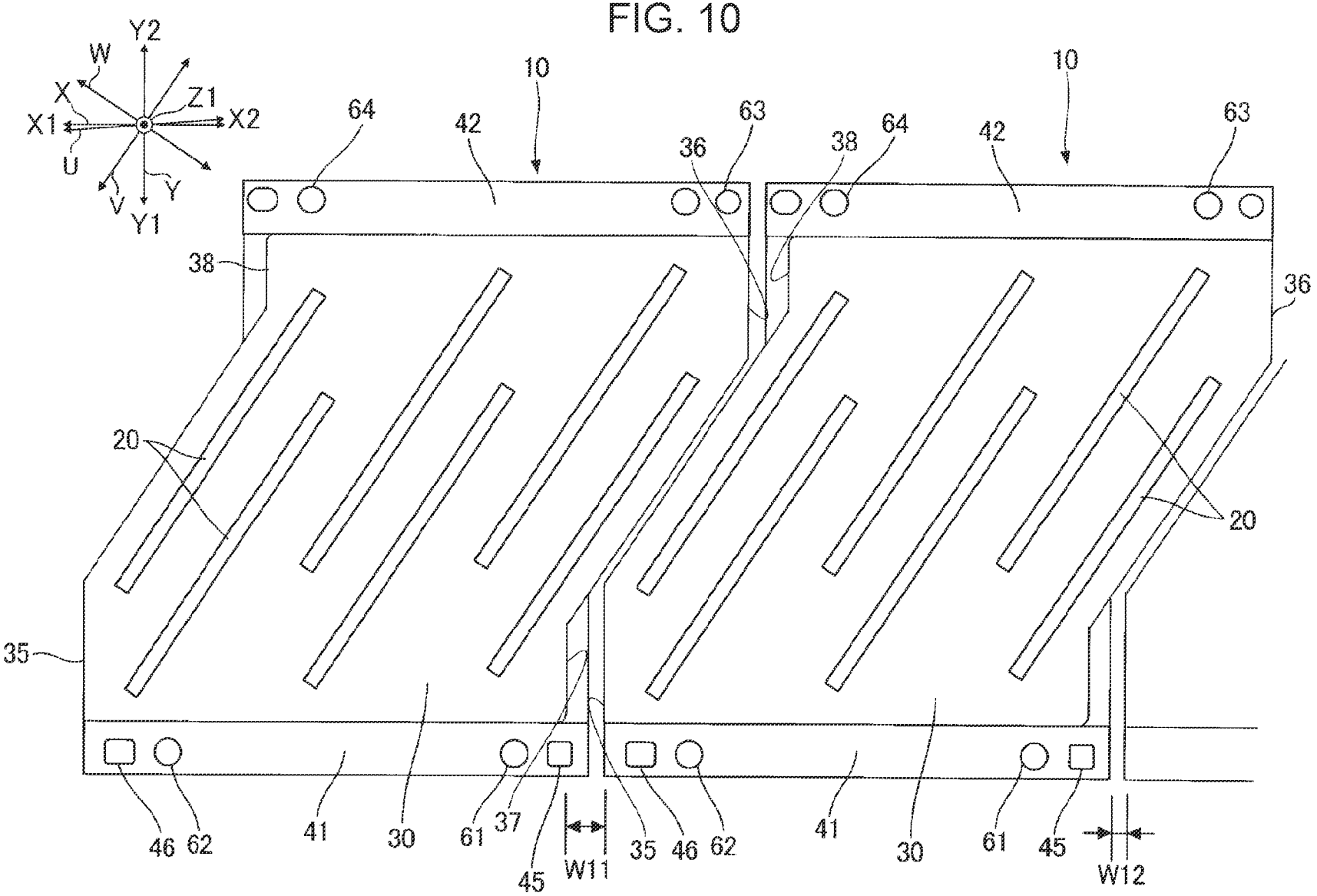
FIG. 10 is a bottom view showing ejection surfaces of a plurality of liquid ejecting heads arranged in an X-axis direction.

FIG. 10 is a bottom view showing ejection surfaces 30 of the plurality of liquid ejecting heads 10 arranged in the X-axis direction. As shown in FIG. 10, in the adjacent liquid ejecting heads 10, a width W11 of the gap between the edge 37 of one liquid ejecting head 10 and the edge 35 of the other liquid ejecting head 10 is wider than a width W12 of the gap between the holders 13. In other words, in the liquid ejecting heads 10 adjacent to each other in the X-axis direction, the width W11 between the ejection surfaces 30 is wider than the width W12 between the holders 13.

As shown in FIG. 5, a wall surface 13*a* defining the edge 37 is disposed inside a wall surface 13*b* defining the edge 157 of the holder 13 in the X-axis direction. A wall surface 13*c* defining the edge 32 extends inward of the wall surface 13*b* in the X-axis direction. The end portion 37*b*, which is the intersection of the edge 32 and the edge 37, is positioned in the X1 direction with respect to the wall surface 13*b*.

With the liquid ejecting head 10, the wall surface 13*a* is located inside with respect to the outer shape of the holder 13, and thus the width W11 between the ejection surfaces 30 in the Y-axis direction can be secured more widely. As a result, the suction of ink due to the capillary phenomenon is reduced in the vicinity of the ejection surface 30 in the Z-axis direction.

Similarly, in the present embodiment, the length of the edge 38 is shorter than the length of the edge 36. Therefore, in the adjacent liquid ejecting heads 10, the width of the gap between the edge 36 of one liquid ejecting head 10 and the edge 38 of the other liquid ejecting head 10 is also wider than the width W12 of the gap between the holders 13.

Figure 11:
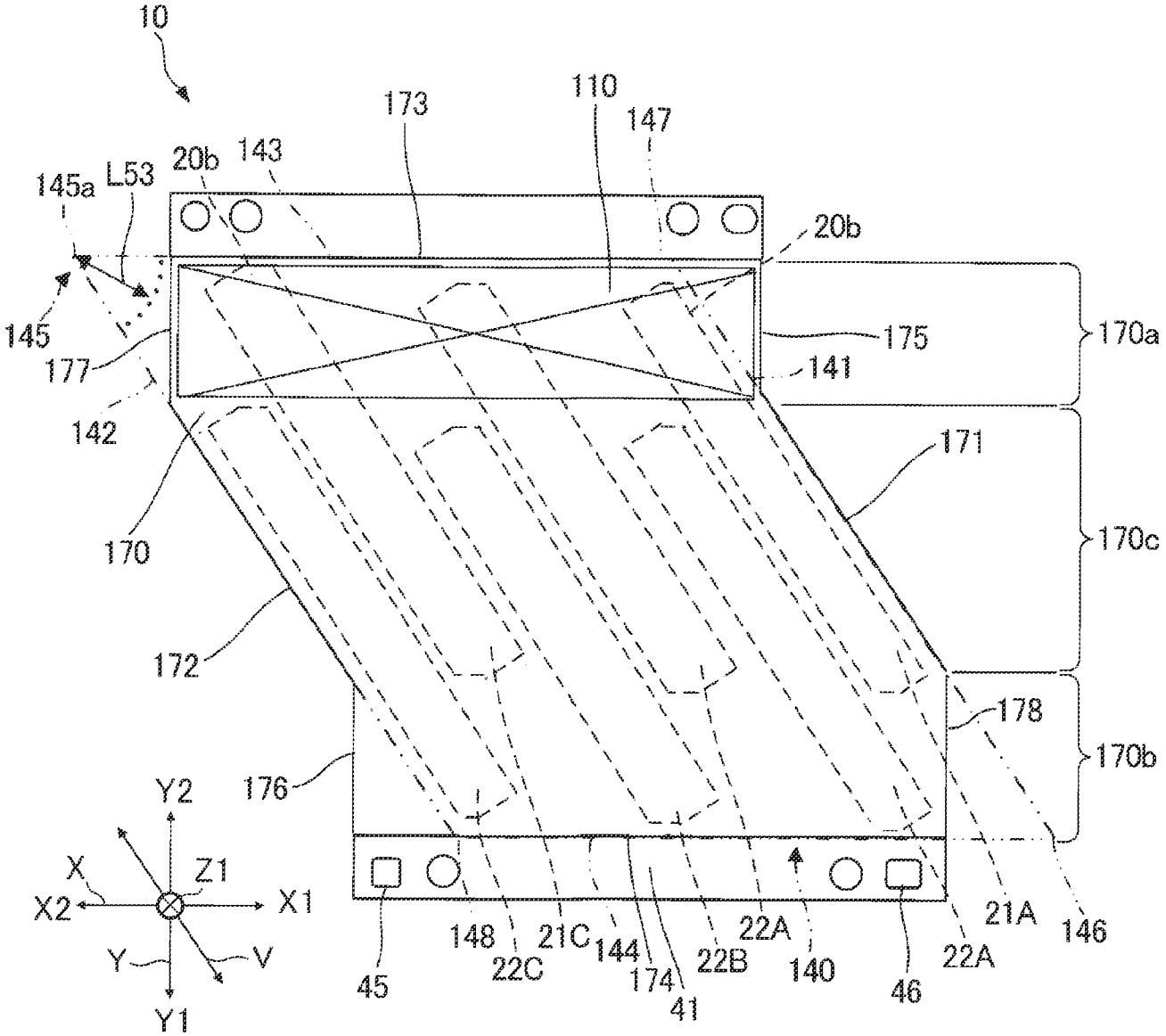
FIG. 11 is a plan view showing an upper surface of a liquid ejecting head.
Figure 12:
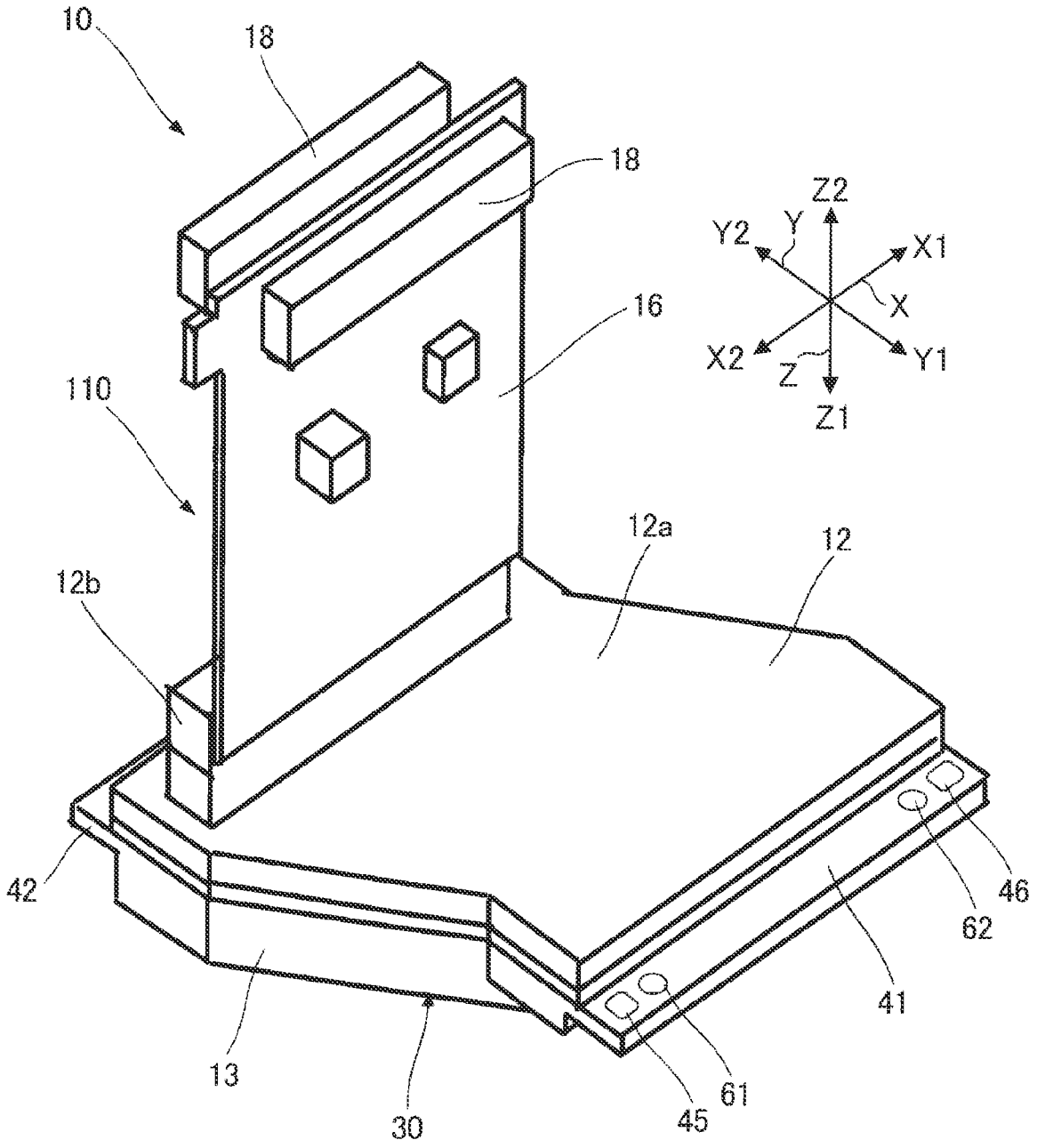
FIG. 12 is a perspective view showing a wiring substrate and a relay substrate of a liquid ejecting head.
Figure 13:
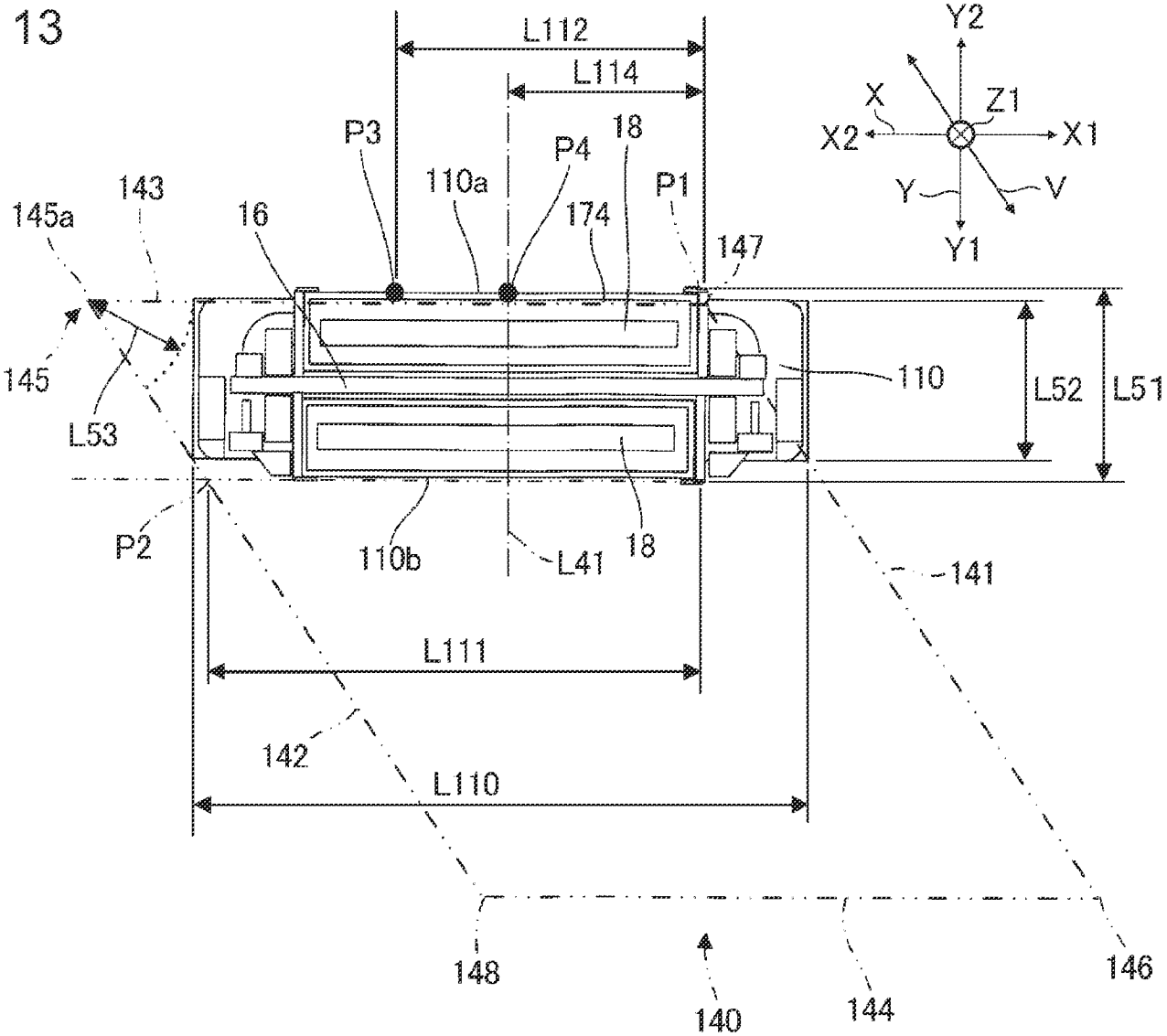
FIG. 13 is a schematic view showing a positional relationship between a virtual parallelogram corresponding to an outer shape of an upper surface and an electrical coupling portion.

Next, the upper surface 170 of the liquid ejecting head 10 will be described with reference to FIG. 11. FIG. 11 is a plan view showing an outer shape of the upper surface 170 of the liquid ejecting head 10. In FIG. 11, the outer shape of the head chip 20 is indicated by a broken line, a virtual parallelogram 140 is indicated by a double-dashed line, and the region of an acute-angled portion 145 is indicated by a dotted line. In FIG. 11, the electrical coupling portion 110 is schematically illustrated as a rectangular frame. The electrical coupling portion 110 has a substantially rectangular shape in a plan view, as shown in FIG. 13 to be described later. FIG. 12 is a perspective view showing the wiring substrate 12 and the relay substrate 16. The liquid ejecting head 10 includes an upper surface 170 facing the opposite side of the ejection surface 30 in the Z-axis direction, and the electrical coupling portion 110 disposed to overlap the end portion 170*a* of the upper surface 170.

The electrical coupling portion 110 is disposed at the end portion 170*a* of the upper surface 170 in the Y-axis direction when the upper surface 170 is viewed in the Z-axis direction. The end portion 170*a* is an end portion in the Y2 direction. The electrical coupling portion 110 may include the connector 12*b*, the relay substrate 16, and the connector 18, which are described above. The electrical coupling portion 110 may include the covers 19A and 19B.

The electrical coupling portion 110 has a rectangular shape when viewed in the Z-axis direction. The electrical coupling portion 110 forms a rectangular shape that is long in the X-axis direction. "the rectangular shape that is long in the X-axis direction" includes that the length in the X-axis direction is longer than the length in the Y-axis direction when viewed in the Z-axis direction. The rectangular shape includes a substantially rectangular shape. The substantially rectangular electrical coupling portion 110 includes a portion that projects in the X-axis direction and a portion that projects in the Y-axis direction when viewed in the Z-axis direction.

Next, the outer shape of the upper surface 170 will be described with reference to FIG. 11. The upper surface 170 has edges 171 to 178. As described above, the upper surface 170 is the upper surface of the top plate 17. The edges 171 and 172 extend linearly in the V direction. The edges 171 and 172 are separated from each other in the X-axis direction.

The edges 173 and 174 form both end portions of the upper surface 170 in the Y-axis direction, respectively. The edges 173 and 174 extend linearly in the X-axis direction. The edge 173 forms an end portion 170*a* of the upper surface 170 in the Y2 direction. The edge 174 forms an end portion 170*b* of the upper surface 170 in the Y1 direction.

The edge 175 is in contact with the edge 171 and the edge 173 in the Y-axis direction. The edge 176 is contact with the edge 172 and the edge 174 in the Y-axis direction.

The edge 177 is positioned at an end portion of the upper surface 170 in the X2 direction. The edge 177 is in contact with the edge 172 and the edge 173 in the Y-axis direction. The edge 178 is positioned at an end portion of the upper surface 170 in the X1 direction. The edge 178 is in contact with the edge 171 and the edge 174 in the Y-axis direction.

Next, the virtual parallelogram 140 corresponding to the outer shape of the upper surface 170 will be described with reference to FIG. 11. The virtual parallelogram 140 is different from the virtual parallelogram 120 described above. The virtual parallelogram 140 has virtual sides 141 to 144. The virtual sides 141 and 142 are hypotenuses in the V direction. The virtual sides 141 and 142 are separated from each other in the X-axis direction. The virtual sides 143 and 144 extend in the X direction.

The virtual parallelogram 140 has acute-angled portions 145 and 146 and obtuse-angled portions 147 and 148. The virtual sides 142 and 143 form the acute-angled portion 145. The virtual side 141 and the virtual side 144 form the acute-angled portion 146. The virtual sides 141 and 143 form the obtuse-angled portion 147. The virtual side 142 and the virtual side 144 form the obtuse-angled portion 148. All head chips 20 are disposed inside the virtual parallelogram 140 when viewed in the Z-axis direction. As shown in FIG. 4, the upper surface 170 is disposed above the head chips 20.

The edge 175 is disposed outside the obtuse-angled portion 147 of the virtual parallelogram 140 in the X-axis direction. The edge 175 is positioned in the X1 direction with respect to the obtuse-angled portion 147.

The edge 176 is disposed outside the obtuse-angled portion 148 of the virtual parallelogram 140 in the X-axis direction. The edge 176 is positioned in the X2 direction with respect to the obtuse-angled portion 148.

The edge 177 extends linearly in the Y-axis direction between the acute-angled portion 145 and the head chip 20 closest to the acute-angled portion 145 in the X-axis direction. The edge 177 is positioned between the acute-angled portion 145 and the head chip 21C in the X-axis direction. The edge 177 is positioned between the acute-angled portion 145 and the head chip 22C in the X-axis direction.

The edge 178 extends directly in the Y-axis direction between the acute-angled portion 146 and the head chip 20 closest to the acute-angled portion 146 in the X-axis direction. The edge 178 is positioned between the acute-angled portion 146 and the head chips 21A and 22B in the X-axis direction.

As shown in FIG. 11, the upper surface 170 includes the end portion 170*a*, the end portion 170*b*, and a central portion 170*c* when viewed in the Z-axis direction. The end portion 170*a* and the end portion 170*b* form a rectangular shape that is long in the X-axis direction. The rectangular shape may include a substantially rectangular shape, and for example, includes the shape in which the lengths of the pair of short sides do not completely match, the shape in which the lengths of the pair of long sides do not completely match, or the shape in which the corner has an R shape. The end portion 170*a* has a rectangular shape having the edge 175 and the edge 177 as short sides, and a straight line facing the edge 173 and parallel to the edge 173 and the edge 173 as long sides.

The straight line facing the edge 173 and parallel to the edge 173 can be expressed differently as the straight line connecting the end of the edge 175 which is the opposite side of the edge 173 and the end of the edge 177 which is the opposite side of the edge 173. The end portion 170*b* has a rectangular shape having the edge 176 and the edge 178 as short sides, and a straight line facing the edge 174 and parallel to the edge 174 and the edge 174 as long sides.

The straight line facing the edge 174 and parallel to the edge 174 can be expressed differently as the straight line connecting the end of the edge 176 which is opposite side of the edge 174 and the end of the edge 178 opposite side of the edge 174. The end portion 170*a* and the end portion 170*b* are separated from each other in the Y-axis direction. The central portion 170*c* is disposed between the end portions 170*a* and the end portions 170*b* in the Y-axis direction. A plurality of flow path pipes 14 are arranged in the central portion 170*c*.

The central portion 170*c* is a parallelogram-shaped portion when viewed in the Z-axis direction. The edges 171 and 172 of the upper surface 170 correspond to the hypotenuses of the central portion 170*c* of the parallelogram shape. "parallelogram shape" includes a shape that is a substantially parallelogram, and includes, for example, the shape in which the lengths of the opposing hypotenuses do not completely match. The end portion 170*a*, the central portion 170*c*, and the end portion 170*b* are arranged in this order in the Y-axis direction. The central portion 170*c* is adjacent to the end portion 170*a* in the Y1 direction. That is, the parallelogram, which is the outer shape of the central portion 170*c*, has a long side facing the edge 173 of the end portion 170*a* as one side. The central portion 170*c* is adjacent to the end portion 170*b* in the Y2 direction. That is, the parallelogram, which is the outer shape of the central portion 170*c*, has a long side facing the edge 174 of the end portion 170*b* as one side. The electrical coupling portion 110 is disposed to overlap the end portion 170*a* when the upper surface 170 is viewed in the Z-axis direction.

The upper surface 170 is not overlapped with the acute-angled portions 145 and 146 when viewed in the Z-axis direction. The upper surface 170 is overlapped with the obtuse-angled portions 147 and 148 when viewed from the Z axis. The upper surface 170 projects to the outside of the obtuse-angled portions 147 and 148 in the X-axis direction. The upper surface 170 projects outward from an apex of the obtuse-angled portion 147 in the X1 direction, and projects outward from an apex of the obtuse-angled portion 148 in the X2 direction.

The range of the acute-angled portion 145 can be, for example, a predetermined length L53 from an apex 145*a* of the acute-angled portion 145. The predetermined length L53 indicating the range of the acute-angled portion 145 can be 10% or more and 50% or less of a maximum length L52 (see FIG. 13) of the electrical coupling portion 110 in the Y-axis direction. The predetermined length L53 may be 30% or more and 50% or less of the maximum length L52 of the electrical coupling portion 110 in the Y-axis direction. The range of the acute-angled portion 146 can be set similarly to the range of the acute-angled portion 145.

The range of the obtuse-angled portion 147 can be set similarly to, for example, the obtuse-angled portion 133 of the virtual parallelogram 120. The range of the obtuse-angled portion 147 can be set based on the width W20 of the head chip 20. The range of the obtuse-angled portion 147 may be 10% or more and 50% or less of the maximum length L52 of the electrical coupling portion 110 in the Y-axis direction, similarly to the acute-angled portion 145. The range of the obtuse-angled portion 148 can be set similarly to the obtuse-angled portion 147.

Next, the size and position of the electrical coupling portion 110 when viewed in the Z-axis direction will be described with reference to FIG. 11. The electrical coupling portion 110 projects outward from the apex of the obtuse-angled portion 147 in the X-axis direction. Here, the fact "the electrical coupling portion 110 projects outward from the apex of the obtuse-angled portion 147 in the X-axis direction" means that, when viewed in the Z-axis direction, a portion of the electrical coupling portion 110 is positioned in the X1 direction with respect to a straight line passing through the apex of the obtuse-angled portion 147 and extending in the Y axis orthogonal to the X axis. Further, the electrical coupling portion 110 projects out beyond the virtual side 141 in the X-axis direction.

The electrical coupling portion 110 does not project outward from the apex of the acute-angled portion 145 in the X-axis direction. The electrical coupling portion 110 does not project out beyond the virtual side 142 in the X-axis direction.

Next, a relationship between a distance L111 between points P1 and P2 of the virtual parallelogram 140 and a maximum length L110 of the electrical coupling portion 110 in the X-axis direction will be described with reference to FIG. 13. FIG. 13 is a schematic view showing the positional relationship between the virtual parallelogram 140 facing the outer shape of the upper surface 170 and the electrical coupling portion 110. In FIG. 13, the virtual parallelogram 140 is indicated by a double-dashed line, and the region of the acute-angled portion 145 is indicated by a dotted line.

The point P1 is an intersection of the virtual side 141 and the virtual side 143. The point P1 is an apex of the obtuse-angled portion 147. The point P2 is an intersection of a virtual straight line parallel to the virtual side 143 passing through an end portion 110*b* of the electrical coupling portion 110 in the Y-axis direction and the virtual side 142. The end portion 110*b* of the electrical coupling portion 110 is an end portion farther from the edge 174 among both end portions in the Y-axis direction.

The maximum length L110 of the electrical coupling portion 110 in the X-axis direction is longer than the distance L111 from the point P1 to the point P2 in the X-axis direction.

Next, the positional relationship between a center point P3 of the virtual side 143 in the X-axis direction and a center point P4 of the electrical coupling portion 110 in the X-axis direction will be described with reference to FIG. 13. The center point P4 of the electrical coupling portion 110 in the X-axis direction is disposed at a position closer to the obtuse-angled portion 147 in the X-axis direction than the center point P3 of the virtual side 143. A distance L114 from the point P4 to the point P1 which is the apex of the obtuse-angled portion 147 is shorter than a distance L112 from the point P3 to the point P1.

Next, a positional relationship between the ejection surface 30 and the upper surface 170 when viewed in the Z-axis direction will be described with reference to FIGS. 6 and 11. The ejection surface 30 and the upper surface 170 have substantially the same outer shape when viewed in the Z-axis direction. As shown in FIG. 6, the edges 37 and 38 of the ejection surface 30 are disposed inward in the X-axis direction with respect to the edges 175 and 176 of the upper surface 170.

Next, a positional relationship between the electrical coupling portion 110 and the plurality of nozzles N of the ejection surface 30 will be described with reference to FIGS. 7 and 11. As shown in FIG. 7, the ejection surface 30 has the plurality of nozzles N.

The plurality of nozzles N are disposed to be overlapped with the end portion 170*a*, the central portion 170*c*, and the end portion 170*b* of the upper surface 170 when viewed in the Z-axis direction. As shown in FIG. 11, some of the plurality of nozzles N are overlapped with the electrical coupling portion 110 when viewed in the Z-axis direction. Further, the electrical coupling portion 110 is disposed on the end portions 20*b* of the head chips 21A, 21B, and 21C when viewed in the Z-axis direction.

Next, the symmetry of the electrical coupling portion 110 will be described with reference to FIG. 13. The electrical coupling portion 110 is a line symmetric with respect to a virtual straight line L41 extending in Y-axis direction through center point P4 of the electrical coupling portion 110 in the X-axis direction.

Next, lengths L51 and L52 of the electrical coupling portion 110 in the Y-axis direction will be described with reference to FIG. 13. The length L51 is the length of the portion of the electrical coupling portion 110 along the virtual line L41 passing through the center point P4 in the Y-axis direction. The length L52 is the length, in the Y-axis direction, of the end of the electrical coupling portion 110 in the X-axis direction. The length L51 of the central portion of the electrical coupling portion 110 in the Y-axis direction is longer than the length L52, in the Y-axis direction, of the end portion in the X-axis direction. Further, as shown in FIG. 13, in the present embodiment, the width of the connector 18 is smaller than the width of the relay substrate 16 in the X-axis direction.

In the liquid ejecting head 10, since the upper surface 170 projects to the outside of the obtuse-angled portion 147 in the X-axis direction, the range of the upper surface 170 on which the electrical coupling portion 110 can be arranged can be expanded. For example, if an upper surface having an outer shape corresponding to the virtual parallelogram 140 is set, the area where the electrical coupling portion 110 can be installed becomes narrow. In the liquid ejecting head 10, since the upper surface 170 is widened to project to the outside of the obtuse-angled portion 147, a wide connector 18 wider in the X-axis direction than in the Y-axis direction can be disposed.

In the liquid ejecting head 10, the center point P4 of the electrical coupling portion 110 is disposed closer to the obtuse-angled portion 147 than the center point P3 of the virtual side 143 in the X-axis direction. Therefore, the distance from the electrical coupling portion 110 to the coupling portion of the wiring member 80 of the head chips 20 of the wiring substrate 12 can be shortened.

In the liquid ejecting head 10, the electrical coupling portion 110 is disposed to be overlapped with some of the plurality of nozzles N when viewed in the Z-axis direction. That is, the electrical coupling portion 110 is disposed near the head chips 20. In the liquid ejecting head 10, the wiring distance from the electrical coupling portion 110 to the wiring member 80 provided on the head chip 20 can be shortened. In the liquid ejecting head 10, the distance between the electrical coupling portion 110 and the wiring member 80 can be shortened to miniaturize the liquid ejecting head 10.

In the liquid ejecting head 10, the shape of the end portion 170*a* of the upper surface 170 is a rectangular shape that is long in the X-axis direction. With the liquid ejecting head 10, the electrical coupling portion 110 that is long in the X-axis direction is easily disposed to be overlapped with the end portion 170*a* of the upper surface 170 when viewed in the Z-axis direction.

In the liquid ejecting head 10, since the relay substrate 16 is covered with the covers 19A and 19B, the relay substrate 16 can be protected. In the liquid ejecting head 10, for example, ink is prevented from adhering to the relay substrate 16. The electrical coupling portion 110 may not be provided with the covers 19A and 19B.

The electrical coupling portion 110 is not limited to the configuration including the relay substrate 16 and the connector 18 coupled to the relay substrate 16. For example, the electrical coupling portion 110 may have a configuration in which the connector 12*b* is provided on the wiring substrate 12, and the relay substrate 16 and the connector 18 are not included. The plate thickness direction of the relay substrate 16 does not have to be in the Y-axis direction, and may be, for example, in the X-axis direction, the Z-axis direction, or any other direction. The electrical coupling portion 110 may be disposed to pass through an opening provided at the end portion 170*a* of the upper surface 170.

Although one electrical coupling portion 110 is provided to be overlapped with the end portion 170*a* of the upper surface 170 when viewed in the Z-axis direction, two electrical coupling portions 110 may be provided to be overlapped with each of the end portion 170*a* and the end portion 170*b* of the upper surface 170.

Next, positioning portions 45 and 46 of the liquid ejecting head 10 will be described with reference to FIGS. 2, 4, and 6. The liquid ejecting head 10 includes the positioning portions 45 and 46. The positioning portions 45 and 46 are positioned with respect to a head holding member 53 that holds the plurality of liquid ejecting heads 10. The head holding member 53 will be described later with reference to FIG. 18.

The positioning portions 45 and 46 are provided on the flange portion 41. The positioning portions 45 and 46 are separated from each other in the X-axis direction. The positioning portion 45 is disposed at the end portion of the flange portion 41 in the X2 direction, and the positioning portion 46 is disposed at the end portion thereof in the X1 direction. The positioning portions 45 and 46 have openings penetrating in the Z-axis direction, which is the thickness direction of the flange portion 41. In the positioning portions 45 and 46, convex portions on a mating part to be positioned are fitted. The convex portion on the mating part is provided on, for example, the head holding member 53.

The convex portion on the mating part is, for example, a columnar pin. Each of the inner peripheral surfaces of the openings of the positioning portions 45 and 46 comes into contact with the convex portion on the mating part in the direction intersecting the Z-axis direction. As a result, the liquid ejecting head 10 is positioned with its movement constrained in the X-axis direction and the Y-axis direction.

The positioning portions 45 and 46 are not limited to the openings, and may be other recesses. The positioning portions 45 and 46 may be concave portions on the mating part or convex portions that fit into the openings. The shapes of the positioning portions 45 and 46 may be circular, rectangular, or other shapes when viewed in the Z-axis direction.

Further, the opening shapes of the positioning portions 45 and 46 as seen in the Z-axis direction may be different in the Z-axis direction. In the present embodiment, the opening shape of the positioning portion 45 is a substantially square shape, and the opening shape of the positioning portion 46 is a substantially rectangular shape that is long in the X-axis direction, which is the direction in which the positioning portions 45 and 46 are arranged. In this way, positioning can be performed even if the convex portions (positioning pins 47, 48) on the mating part are displaced due to manufacturing errors in the X-axis direction. The same effect can be obtained by forming at least one opening shape of the positioning portions 45 and 46 into an oval shape that is long in the X-axis direction, which is the direction in which the positioning portions 45 and 46 are arranged.

When the positioning portions 45 and 46 are convex portions, the convex portions may protrude in the Z1 direction or may protrude in the Z2 direction, from the flange portion 41. Further, the positioning portions 45 and 46 may be provided on the flange portion 42. The positioning portions 45 and 46 may be provided in other parts of the holder 13, or may be provided in a part other than the holder 13 in the liquid ejecting head 10.

Figure 14:
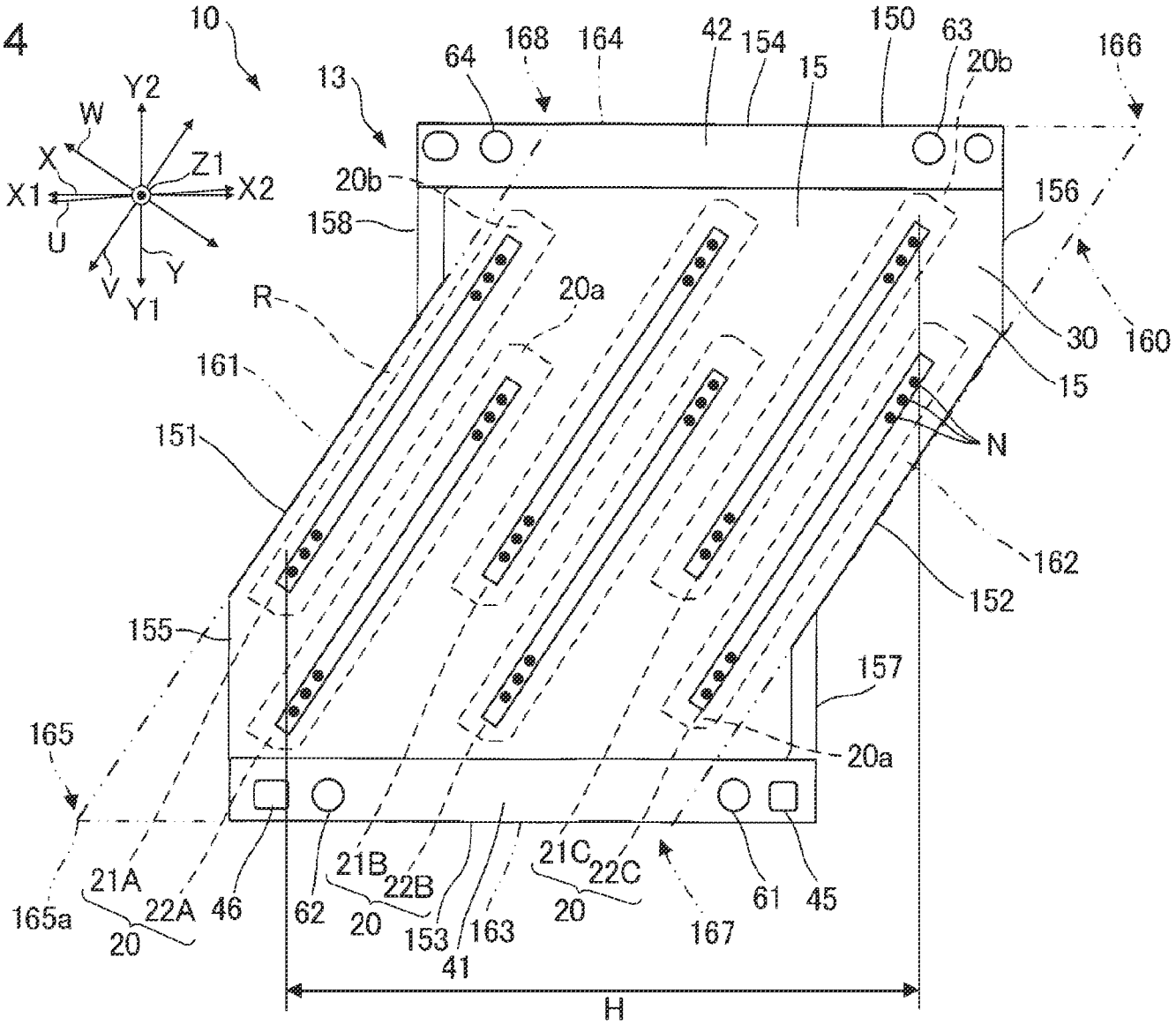
FIG. 14 is a bottom view showing an ejection surface of a liquid ejecting head, in which a virtual parallelogram corresponding to an outer shape of the liquid ejecting head when viewed in the normal direction of the ejection surface is shown.

Next, an outer shape 150 of the liquid ejecting head 10 when viewed in the Z-axis direction will be described with reference to FIG. 14. FIG. 14 is a bottom view showing the ejection surface 30 of the liquid ejecting head 10. In FIG. 14, the outer shape of the head chip 20 is indicated by a broken line, and a virtual parallelogram 160 is indicated by a double-dashed line. When viewed in the Z-axis direction, the outer shape 150 of the liquid ejecting head 10 is the outer shape of the holder 13. The holder 13 has edges 151 to 158. The edges 151 to 158 form the outer shape 150 of the liquid ejecting head 10. The edges 151 and 152 extend linearly in the V direction. The edges 151 and 152 are separated from each other in the X-axis direction.

The edges 153 and 154 are disposed at both end portions of the holder 13 in the Y-axis direction. The edges 153 and 154 are separated from each other in the Y-axis direction and extend linearly in the X-axis direction. The edge 153 forms an end portion of the holder 13 in the Y1 direction. The edge 154 forms an end portion of the holder 13 in the Y2 direction. The edge 153 is disposed at the end portion of the flange portion 41 in the Y1 direction. The edge 154 is disposed at the end portion of the flange portion 42 in the Y2 direction.

The edge 155 is disposed at the end portion of the holder 13 in the X1 direction. The edge 155 is in contact with the edge 151 and the edge 153 in the Y-axis direction. The edge 155 extends linearly in the Y-axis direction. The edge 156 is disposed at the end portion of the holder 13 in the X2 direction. The edge 156 is in contact with the edge 152 and the edge 154 in the Y-axis direction. The edge 156 extends linearly in the Y-axis direction.

The edge 157 is the opposite side of the edge 155 in the X-axis direction and extends linearly in the Y-axis direction. The edge 157 is in contact with the edge 152 and the edge 153 in the Y-axis direction. The edge 158 is the opposite side of the edge 156 in the X-axis direction and extends linearly in the Y-axis direction. The edge 158 is in contact with the edge 151 and the edge 154 in the Y-axis direction.

Next, the virtual parallelogram 160 corresponding to the outer shape 150 of the liquid ejecting head 10 will be described. The virtual parallelogram 160 is different from the virtual parallelograms 120 and 140 described above. The virtual parallelogram 160 has virtual sides 161 to 164. The virtual sides 161, 162 are hypotenuses in the V direction. The virtual side 161 is arranged along the edge 151 of the holder 13. The virtual side 162 is arranged along the edge 152 of the holder 13. The virtual sides 161 and 162 are separated from each other in the X-axis direction. The virtual side 163 is arranged along the edge 153 of the holder 13. The virtual side 164 is arranged along the edge 154 of the holder 13. The virtual sides 163 and 164 extend in the X-axis direction.

The virtual parallelogram 160 has acute-angled portions 165 and 166 and obtuse-angled portions 167 and 168. The virtual sides 161 and 163 form the acute-angled portion 165. The virtual sides 162 and 164 form the acute-angled portion 166. The virtual sides 162 and 163 form the obtuse-angled portion 167. The virtual sides 161, 164 form the obtuse-angled portion 168. All head chips 20 are located inside the virtual parallelogram 160 when viewed in the Z-axis direction.

Next, the positional relationship between the positioning portion 45 and the virtual parallelogram 160 will be described. The positioning portion 45 is disposed at a position that is not overlapped with the virtual parallelogram 160 when viewed in the Z-axis direction. The positioning portion 45 is disposed outside the obtuse-angled portion 167 of the virtual parallelogram 160 in the X-axis direction. The positioning portion 45 is disposed in the X2 direction with respect to the obtuse-angled portion 167.

Figure 15:
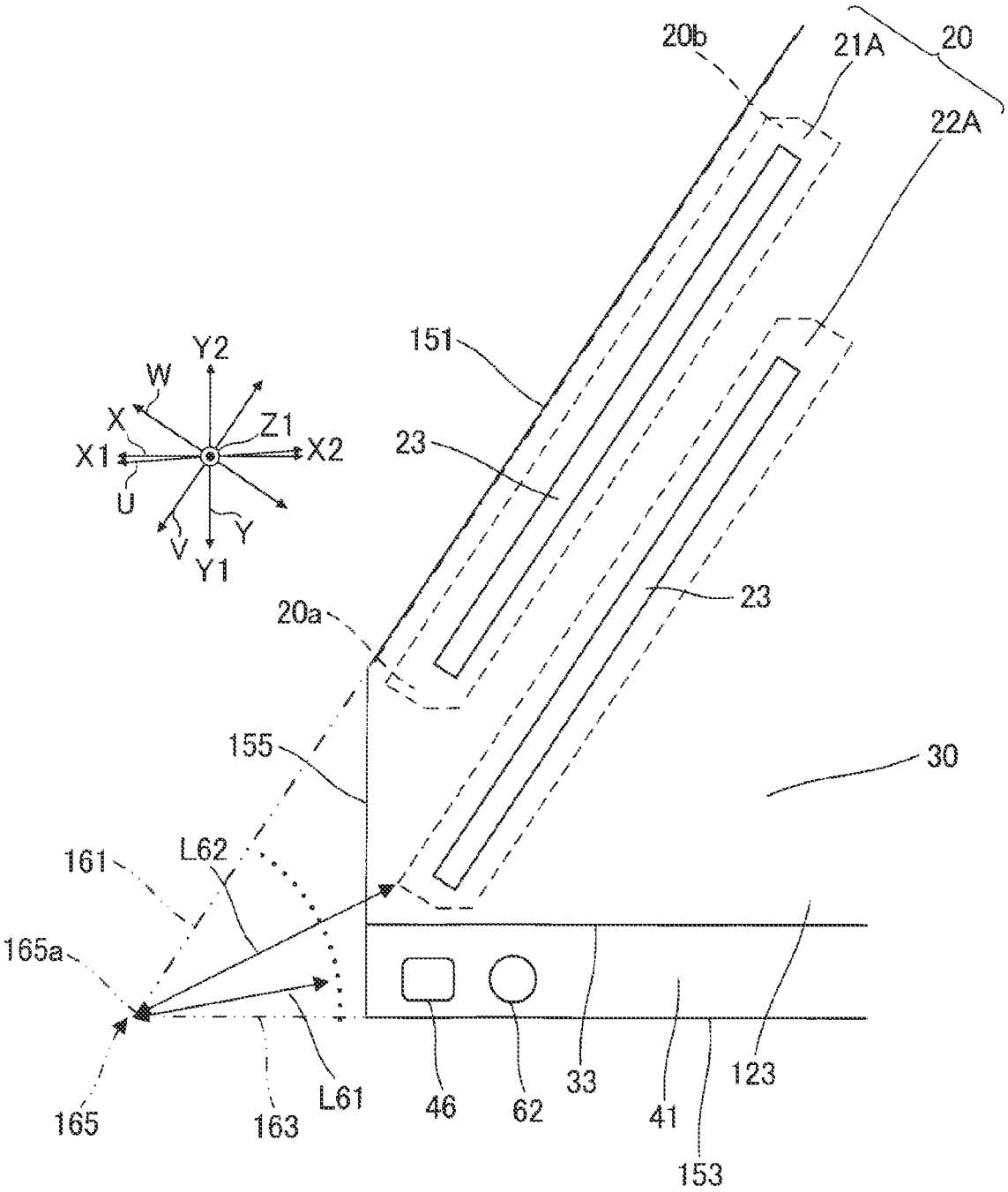
FIG. 15 is a bottom view showing a part of an ejection surface, in which an acute-angled portion of a virtual parallelogram is shown.

Next, the positional relationship between the positioning portion 46 and the virtual parallelogram 160 will be described. As shown in FIGS. 14 and 15, the positioning portion 46 is overlapped with the virtual parallelogram 160 when viewed in the Z-axis direction. The positioning portion 46 is not overlapped with the acute-angled portion 165 of the virtual parallelogram 160.

The range of the acute-angled portion 165 can be, for example, within a predetermined length L61 from an apex 165*a* of the acute-angled portion 165. The predetermined length L61 can be, for example, 80% of a distance L62 from the apex 165*a* to the head chip 22A closest to the apex 165*a*. The predetermined length L61 may be, for example, 50% or more and 90% or less of the distance L62.

Next, screw holes 61 to 64 of the liquid ejecting head 10 will be described with reference to FIG. 14. The screw holes 61 to 64 are examples of fixing portions for fixing the liquid ejecting head 10 to the head holding member 53. The screw holes 61 and 62 are provided in the flange portion 41, and the screw holes 63 and 64 are provided in the flange portion 42. The screw holes 61 and 62 are disposed at both end portions of the flange portion 41 in the longitudinal direction thereof. The screw holes 63 and 64 are disposed at both end portions of the flange portion 42 in the longitudinal direction thereof.

The screw hole 61 is adjacent to the positioning portion 45 in the X-axis direction. The screw holes 61 are disposed in the X1 direction with respect to the positioning portion 45. The screw hole 61 is disposed in the Y1 direction with respect to the end portion 20*a* of the head chip 22C. The screw hole 61 is not overlapped with the virtual parallelogram 160. The screw hole 61 is disposed outside the obtuse-angled portion 167. The screw hole 61 is positioned in the X2 direction with respect to the obtuse-angled portion 167. The screw hole 61 is disposed between the obtuse-angled portion 167 and the positioning portion 45 in the X-axis direction.

The screw hole 62 is adjacent to the positioning portion 46 in the X-axis direction. The screw holes 62 are disposed in the X2 direction with respect to the positioning portion 46. The screw hole 62 is disposed in the Y1 direction with respect to the end portion 20*a* of the head chip 22A. The screw hole 62 is not overlapped with the acute-angled portion 165 when viewed in the Z-axis direction.

The screw hole 63 is disposed in the Y2 direction with respect to the end portion 20*b* of the head chip 21C. The screw hole 63 is not disposed at the acute-angled portion 166 when viewed in the Z-axis direction. The screw hole 64 is disposed in the Y2 direction with respect to the end portion 20*b* of the head chip 21A. The screw hole 64 is not overlapped with the virtual parallelogram 160. The screw hole 64 is disposed outside the obtuse-angled portion 168. The screw hole 64 is positioned in the X1 direction with respect to the obtuse-angled portion 168.

Therefore, the distance between the screw holes 61 and 62 in the X-axis direction in the present embodiment is longer than the distance between the screw holes 61 and 62 in the X-axis direction when the screw holes 61 and 62 are provided in the part of the flange portion 41 that is overlapped with the virtual parallelogram 160. Therefore, when the flange portion 41 is fixed to the head holding member 53 by the screws inserted into the screw holes 61 and 62, it is possible to reduce the misalignment such that the liquid ejecting head 10 rotates around the screw holes 61 or the screw holes 62. The same applies to the screw holes 63 and 64.

Further, the screw holes 61 to 64 are disposed outside the ejection surface 30 in the Y-axis direction. Each of the screw holes 61 to 64 is at least partially disposed within the range H of the plurality of nozzles N that are present on the ejection surface 30 in the X-axis direction. More specifically in the present embodiment, all of the screw holes 61, 62, and 64 are disposed within the range H in the X-axis direction, and the screw hole 63 is partially disposed within the range H in the X-axis direction.

All of the screw holes 61 to 64 may be disposed within the range H in the X-axis direction. As described above, by disposing the screw holes 61 to 64 in the vicinity of the plurality of nozzles N in the X-axis direction, it is possible to reduce the decrease in alignment accuracy of the nozzles N due to the rotational deviation of the ejection surface 30 with the Z axis as the rotation axis with respect to the head holding member 53.

Screws are inserted into the screw holes 61 to 64, respectively. The flange portions 41 and 42 are screwed to the head holding member 53 by the screws inserted into the screw holes 61 to 64. As a result, the liquid ejecting head 10 is fixed to the head holding member 53.

In the liquid ejecting head 10, positioning portions 45 and 46 are provided at both end portions of the flange portion 41 in the longitudinal direction thereof. Since the positioning portions 45 and 46 can be disposed apart from each other in the X-axis direction, the distance between the positioning portions 45 and 46 can be extended. In the liquid ejecting head 10, the distance between the positioning portions 45 and 46 is widened, which may improve the positioning accuracy.

In the liquid ejecting head 10, the positioning portion 45 is disposed outside the obtuse-angled portion 167. In the liquid ejecting head 10, the position of the positioning portion 45 can be disposed in the X2 direction as compared with the holder having the outer shape corresponding to the virtual parallelogram 160. In the liquid ejecting head 10, it is possible to prevent the positioning portions 45 and 46 from being disposed close to each other, which makes it possible to suppress the deterioration of the positioning accuracy.

In the liquid ejecting head 10, the positioning portion 46 is not overlapped with the acute-angled portion 165 of the virtual parallelogram 160. Since the positioning portion 45 is disposed outside the obtuse-angled portion 167 as described above, even if the outer shape 150 of the liquid ejecting head 10 is not overlapped with the acute-angled portion 165 when viewed in the Z-axis direction to reduce the outer shape of the liquid ejecting head 10 in the X-axis direction, it is possible to prevent the positioning portions 45 and 46 from being disposed close to each other, which makes it possible to suppress the decrease in positioning accuracy.

In the liquid ejecting head 10, the positioning portion 46 is not overlapped with the acute-angled portion 165 of the virtual parallelogram 160. The flange portion 41 has a rectangular shape that is long in the X-axis direction. The rectangular shape may include a substantially rectangular shape, and includes, for example, a shape in which the corner portion has an R shape. For example, in the holder having the outer shape corresponding to the virtual parallelogram 160, an opening is formed in a tapered portion when the positioning portion 46 is disposed at a position overlapped with the acute-angled portion 165. In this case, the strength of the portion in the vicinity of the acute-angled portion 165 is lowered, and thus the portion in the vicinity of the acute-angled portion 165 may be damaged during repeated use of the liquid ejecting head 10.

However, in the liquid ejecting head 10, the positioning portion 46 is not disposed at a position overlapped with the acute-angled portion 165. Accordingly, the decrease in strength of the portion in the vicinity of the positioning portion 46 is avoided, and the risk of damage to the flange portion 41 is reduced. As a result, the reliability of the liquid ejecting head 10 is improved.

Further, in the liquid ejecting head 10, the edges 155 and 156 of the holder 13 are not overlapped with the acute-angled portions 165 and 166 of the virtual parallelogram 160 when viewed in the Z-axis direction. In the X-axis direction, the edges 155 and 156 are disposed between the plurality of head chips 20 and the acute-angled portions 165 and 166. As a result, the increase in size of the holder 13 is avoided in the X-axis direction, and the increase in size of the liquid ejecting head 10 is avoided.

Figure 16:
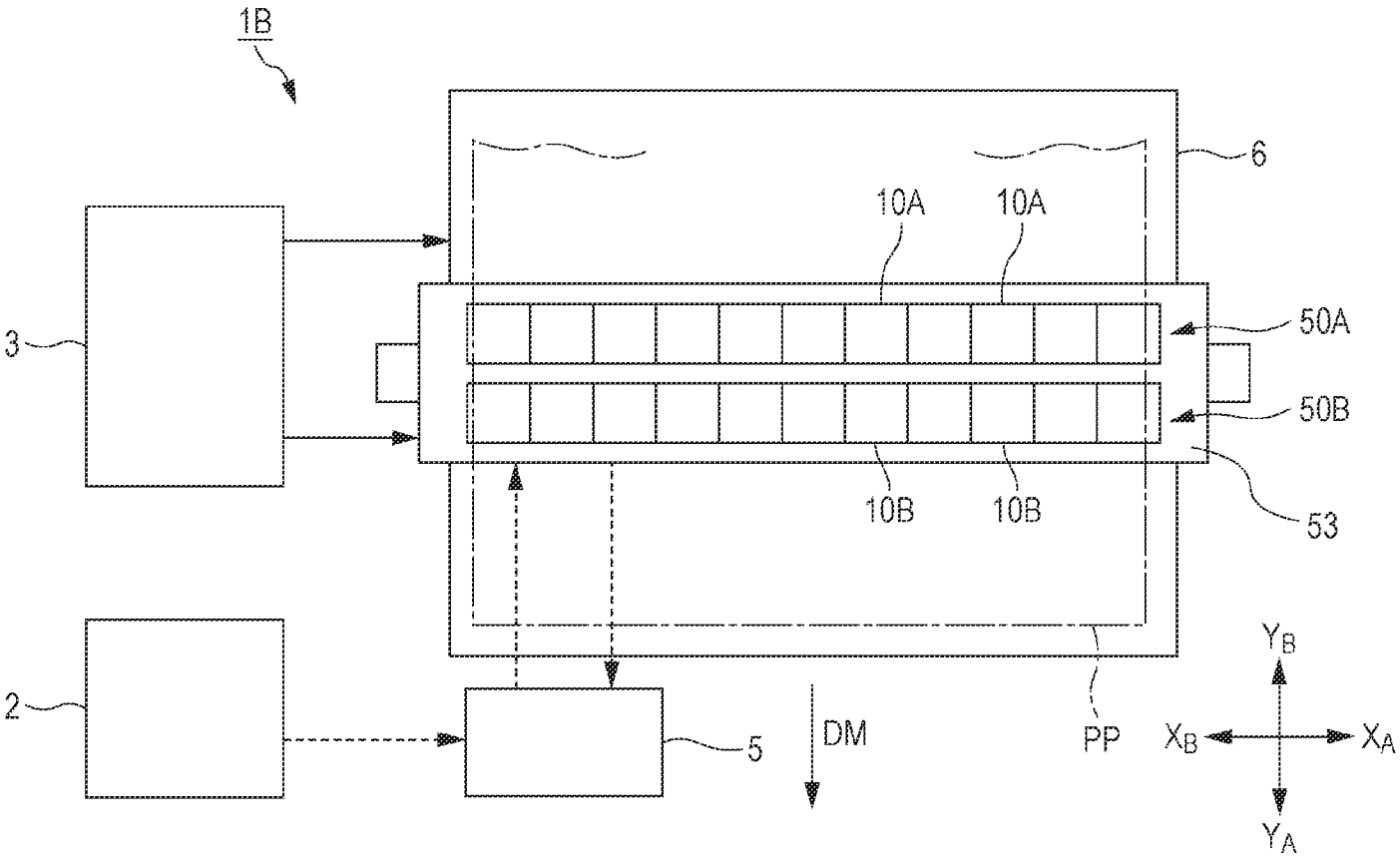
FIG. 16 is a schematic view showing a liquid ejecting apparatus according to a second embodiment.
Figure 17:
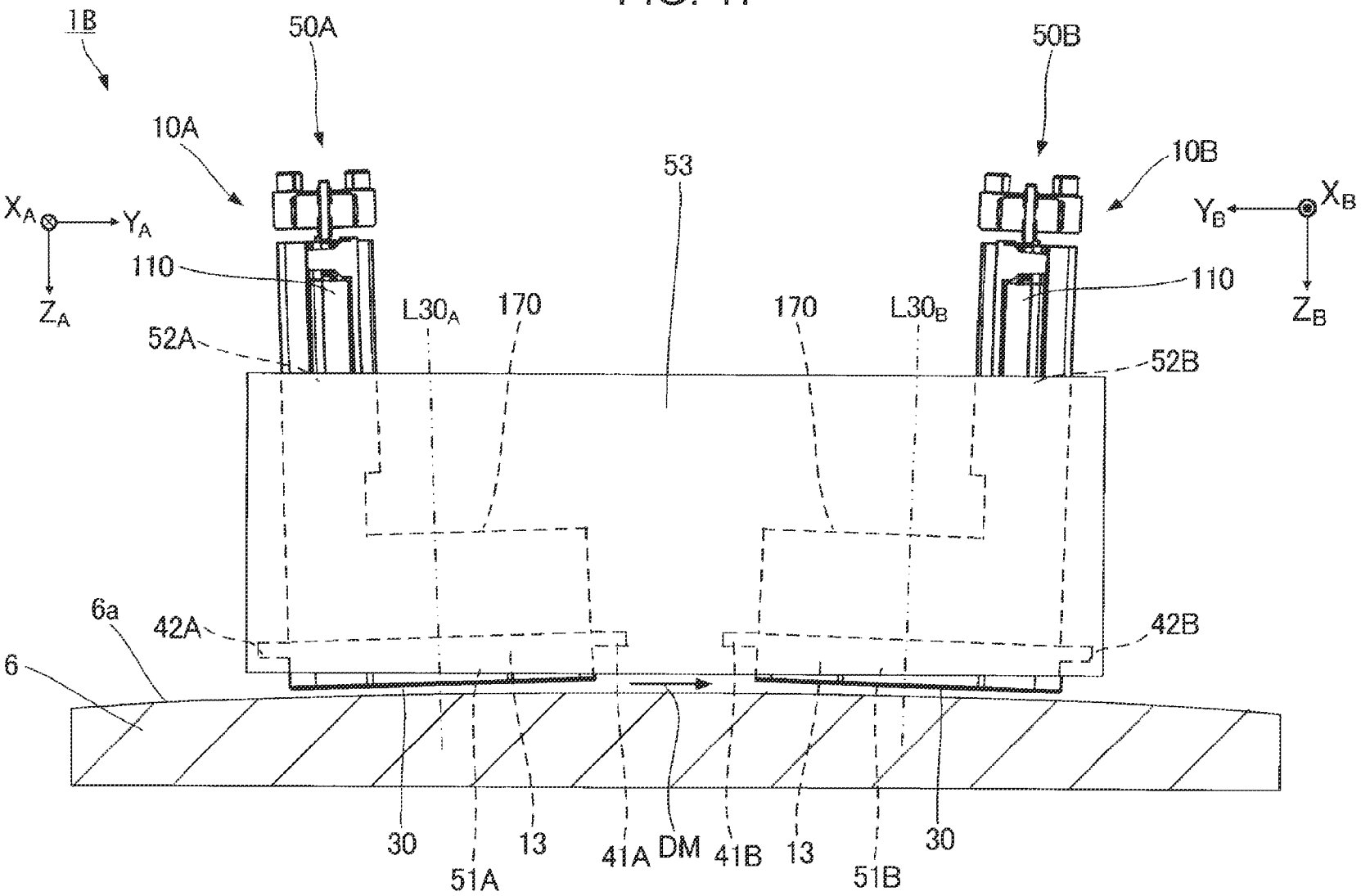
FIG. 17 is a diagram showing a liquid ejecting apparatus when viewed in a direction of the central axis of a transport drum.
Figure 18:
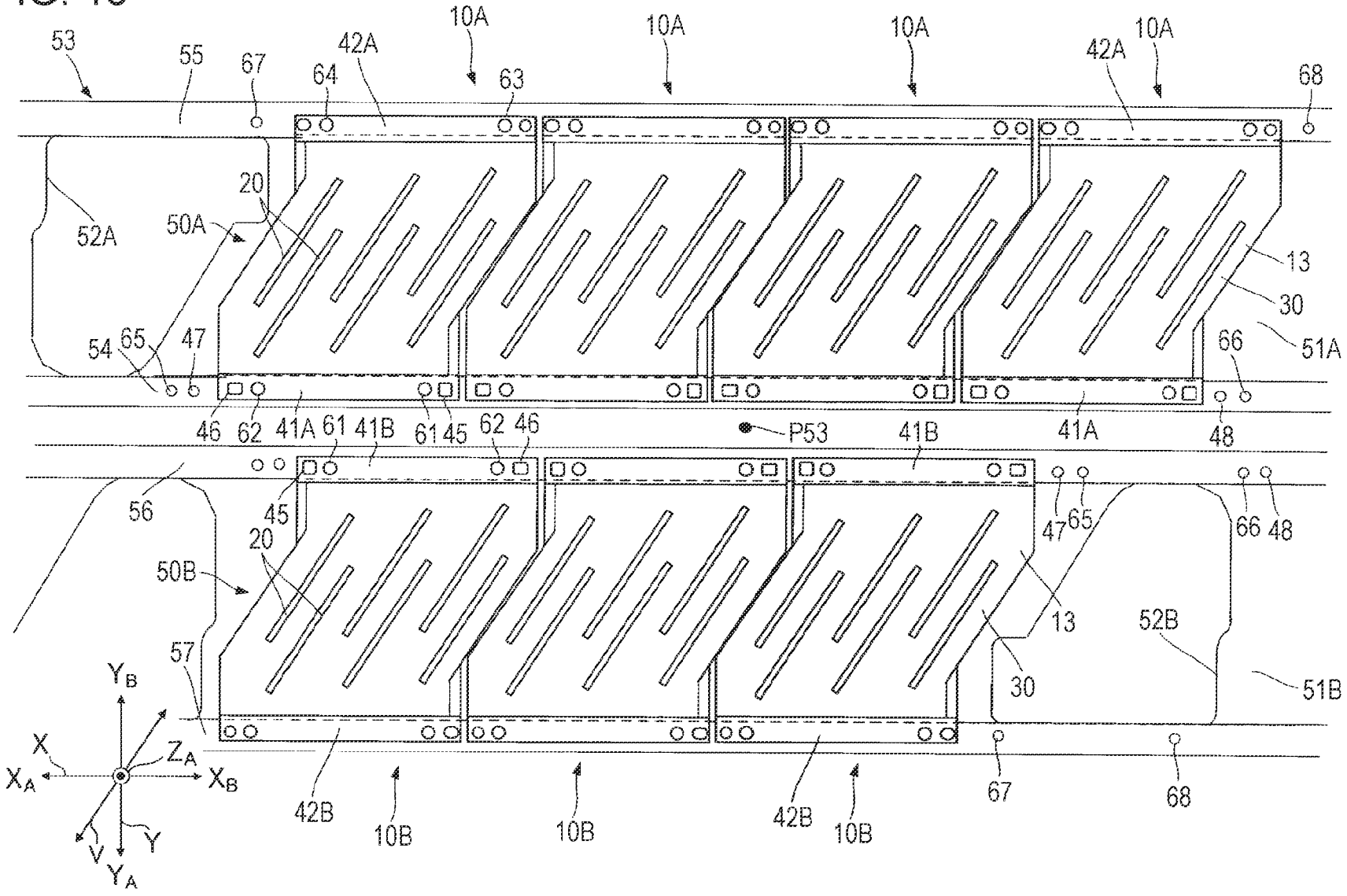
FIG. 18 is a bottom view showing a plurality of line heads arranged apart from each other in a transport direction of a medium.

Next, a liquid ejecting apparatus 1B according to a second embodiment will be described with reference to FIGS. 16 to 18. FIG. 16 is a schematic view showing the liquid ejecting apparatus 1B according to the second embodiment. FIG. 17 is a diagram showing the liquid ejecting apparatus 1B when viewed in a direction of the central axis of a transport drum 6. FIG. 18 is a bottom view showing a plurality of line heads 50A and 50B arranged apart from each other in a transport direction of the medium PP.

The liquid ejecting apparatus 1B according to the second embodiment is different from the liquid ejecting apparatus 1A according to the first embodiment in that it includes a plurality of line heads 50A and 50B. In the description of the liquid ejecting apparatus 1B of the second embodiment, the same description as that of the liquid ejecting apparatus 1A of the first embodiment will be omitted.

The line heads 50A and 50B have the same configuration as the line head 50 of the first embodiment. As shown in FIGS. 16 to 18, the line head 50A is constituted by arranging a plurality of liquid ejecting heads 10A side by side. The line head 50B is constituted by arranging a plurality of liquid ejecting heads 10B side by side. The liquid ejecting heads 10A and 10B have the same configuration as the liquid ejecting head 10 of the liquid ejecting apparatus 1A.

In FIG. 17, an $X_A$-axis direction, a $Y_A$-axis direction, and a $Z_A$-axis direction are shown as three directions regarding the liquid ejecting head 10A. The $X_A$-axis direction, $Y_A$-axis direction, and $Z_A$-axis direction correspond to the X-axis direction, the Y-axis direction, and the Z-axis direction in the liquid ejecting head 10.

An $X_B$-axis direction, a $Y_B$-axis direction, and a $Z_B$-axis direction are shown as three directions regarding the liquid ejecting head 10B. The $X_B$-axis direction, the $Y_B$-axis direction, and the $Z_B$-axis direction correspond to the X-axis direction, the Y-axis direction, and the Z-axis direction in the liquid ejecting head 10.

In the following description, the X-axis direction refers to the $X_A$-axis direction for the liquid ejecting head 10A and the $X_B$-axis direction for the liquid ejecting head 10B. Similarly, the Y-axis direction refers to the $Y_A$-axis direction for the liquid ejecting head 10A, and the $Y_B$-axis direction for the liquid ejecting head 10B. The Z-axis direction refers to the $Z_A$-axis direction for the liquid ejecting head 10A, and refers to the $Z_B$-axis direction for the liquid ejecting head 10B.

The line heads 50A and 50B are arranged apart from each other in the transport direction DM. The transport direction DM is a direction along the circumferential direction of the transport drum 6 when viewed in the central axis direction of the transport drum 6. The central axis direction of the transport drum 6 is a direction along the X-axis direction. The ejection surface 30 of the liquid ejecting heads 10A and 10B faces the outer peripheral surface 6*a* of the transport drum 6. The directions of normal lines $L30_A$ and $L30_B$ of the ejection surface 30 are directions along the normal directions of the outer peripheral surface 6*a* of the transport drum 6. In FIG. 17, the normal line $L30_A$ passing through the center of the ejection surface 30 of the liquid ejecting head 10A in the Y-axis direction is shown, and the normal line $L30_B$ passing through the center of the ejection surface 30 of the liquid ejecting head 10B in the Y-axis direction is shown.

The liquid ejecting head 10A is provided with flange portions 41A and 42A. The liquid ejecting head 10B is provided with flange portions 41B and 42B. The flange portions 41A and 41B have the same configuration as the flange portion 41 of the liquid ejecting head 10, and the flange portions 42A and 42B have the same configuration as the flange portion 42 of the liquid ejecting head 10.

The flange portion 41A of the liquid ejecting head 10A projects toward the liquid ejecting head 10B in the Y-axis direction when viewed in the X-axis direction. The flange portion 41A is disposed at a position closer to the liquid ejecting head 10B than the center of the ejection surface 30 in the Y-axis direction.

The flange portion 42A of the liquid ejecting head 10A projects toward the side opposite to the liquid ejecting head 10B in the Y-axis direction when viewed in the X-axis direction. The flange portion 42A is disposed at a position farther from the liquid ejecting head 10B than the center of the ejection surface 30 in the Y-axis direction.

The flange portion 41B of the liquid ejecting head 10B projects toward the liquid ejecting head 10A in the Y-axis direction when viewed in the X-axis direction. The flange portion 41B is disposed at a position closer to the liquid ejecting head 10A than the center of the ejection surface 30 in the Y-axis direction.

The flange portion 42B of the liquid ejecting head 10B projects toward the side opposite to the liquid ejecting head 10A in the Y-axis direction when viewed in the X-axis direction. The flange portion 42B is disposed at a position farther from the liquid ejecting head 10A than the center of the ejection surface 30 in the Y-axis direction.

Next, the head holding member 53 will be described with reference to FIG. 18. The liquid ejecting apparatus 1B includes that head holding member 53 that holds the line heads 50A and 50B. The head holding member 53 is made of, for example, stainless steel. The material of the head holding member 53 is not limited to stainless steel, and may be other materials such as metal and resin.

The head holding member 53 has fixing surfaces 54 to 57. The fixing surfaces 54 and 55 are used for fixing the liquid ejecting head 10A, and the fixing surfaces 56 and 57 are used for fixing the liquid ejecting head 10B. The fixing surfaces 54 to 57 extend in the X-axis direction. In FIG. 18, the state before the liquid ejecting head 10B is mounted is partially shown.

In the head holding member 53, openings 51A, 51B, 52A, and 52B are formed. In the Z-axis direction, the openings 51A and 51B are disposed closer to the transport drum 6, and the openings 52A and 52B are disposed farther from the transport drum 6.

The opening 51A is an opening for holding the liquid ejecting head 10A. The opening 51A is continuous in the X-axis direction between the fixing surface 54 and the fixing surface 55. A plurality of liquid ejecting heads 10A are inserted into the opening 51A. The opening 51A is formed in the head holding member 53 on a surface facing the outer peripheral surface 6*a* of the transport drum 6. In the head holding member 53, the surface of the transport drum 6 closer to the outer peripheral surface 6*a* is the ejection surface of the head holding member 53. The plurality of liquid ejecting heads 10A are inserted into the opening 51A from the ejection surface side of the head holding member 53 and fixed to the head holding member 53.

The opening 51B is an opening for holding the liquid ejecting head 10B. The opening 51B is continuous in the X-axis direction between the fixing surface 56 and the fixing surface 57. A plurality of liquid ejecting heads 10B are inserted into the opening 51B. The opening 51B is formed on the ejection surface of the head holding member 53. The plurality of liquid ejecting heads 10B are inserted into the opening 51B from the ejection surface side of the head holding member 53 and fixed to the head holding member 53.

The opening 52A is an individual opening corresponding to each of the liquid ejecting heads 10A. The electrical coupling portion 110 of the liquid ejecting head 10A passes through the opening 52A and projects outward from the head holding member 53.

The opening 52B is an individual estuary facing each of the liquid ejecting heads 10B. The electrical coupling portion 110 of the liquid ejecting head 10B passes through the opening 52B and projects outward from the head holding member 53.

The flange portion 41A of the liquid ejecting head 10A is fixed to the fixing surface 54, and the flange portion 42A is fixed to the fixing surface 55. The flange portion 41B of the liquid ejecting head 10B is fixed to the fixing surface 55, and the flange portion 42B is fixed to the fixing surface 57.

Positioning pins 47 and 48 are provided on the fixing surfaces 54 and 56, respectively. The positioning pins 47 and 48 form, for example, a columnar shape. The positioning pin 47 fits into the positioning portion 45. The positioning pin 48 fits into the positioning portion 46. The outer diameter of the positioning pin 47 is slightly smaller than the inner diameter of the opening of the positioning portion 45. The outer diameter of the positioning pin 48 is slightly smaller than the inner diameter of the opening of the positioning portion 46. Therefore, when the positioning pin 47 is inserted into the opening of the positioning portion 45, the positioning pin 47 receives pressure from the inner peripheral surface of the opening of the positioning portion 45. The same applies to the positioning portion 46 and the positioning pin 48.

The hardness of the positioning pins 47 and 48 is higher than the hardness of the flange portions 41A and 41B. For example, a case of using a non-replacement part fixed to the liquid ejecting apparatus 1B and using the liquid ejecting head 10A as a replacement part will be considered. By making the hardness of the positioning pin 47 of the head holding member 53, which is the non-replacement part, higher than the hardness of the positioning portion 45 of the liquid ejecting head 10A, which is the replacement part, the positioning pin 47 is hard to be scraped by positioning, making it unnecessary to replace the head holding member 53, and thus making it possible to reduce the maintenance cost of the liquid ejecting apparatus 1B.

Female screw portions 65 and 66 are provided on the fixing surfaces 54 and 56, and female screw portions 67 and 68 are provided on the fixing surfaces 55 and 57. In FIG. 18, the female screw portions 65 to 68 before the screw is mounted are shown. The female screw portion 65 is provided at a position corresponding to the screw hole 61, and the female screw portion 66 is provided at a position corresponding to the screw hole 62. The female screw portion 67 is provided at a position corresponding to the screw hole 63, and the female screw portion 68 is provided at a position corresponding to the screw hole 64. The screws inserted through the screw holes 61 to 64 are attached to the corresponding female screw portions 65 to 68, respectively. As a result, the liquid ejecting heads 10A and 10B are fixed to the head holding member 53.

Next, the arrangement of the electrical coupling portion 110 in the liquid ejecting apparatus 1B will be described with reference to FIG. 16. In a state where the liquid ejecting heads 10A and 10B are fixed to the head holding member 53, the electrical coupling portion 110 of the liquid ejecting head 10A is disposed on the side opposite to the liquid ejecting head 10B with respect to the center of the ejection surface 30 in the Y-axis direction. Similarly, the electrical coupling portion 110 of the liquid ejecting head 10B is disposed on the side opposite to the liquid ejecting head 10A with respect to the center of the ejection surface 30 in the Y-axis direction.

With the liquid ejecting apparatus 1B described above, the flange portions 41A and 41B are disposed closer to each other in the transport direction DM. Accordingly, the line heads 50A and 50B can be disposed by bring the positioning portions 45 and 46 disposed on the flange portions 41A and 41B close to each other. As a result, the misalignment between the line heads 50A and 50B can be suppressed.

With the liquid ejecting apparatus 1B described above, the electrical coupling portions 110 are disposed far from each other in the transport direction DM. Accordingly, in the line heads 50A and 50B, the distance between the connectors 18 can be secured. For example, when coupling an electric cable to the connector 18 of the line head 50A, the electric cable coupled to the connector 18 of the line head 50B does not get in the way. In a state in which the liquid ejecting apparatus 1B is in use, the distance between the electric cable coupled to the connector 18 of the line head 50A and the electric cable of the connector 18 of the line head 50B is properly maintained, and the electric cables do not come too close to each other.

The head holding member 53 may be formed point-symmetrically when viewed in a direction along the normal line of the outer peripheral surface 6*a* of the transport drum 6. For example, the head holding member 53 is formed point-symmetrically with respect to the center point P53 as shown in FIG. 18. The line heads 50A and 50B are disposed point-symmetrically with respect to the center point P53.

Figure 19:
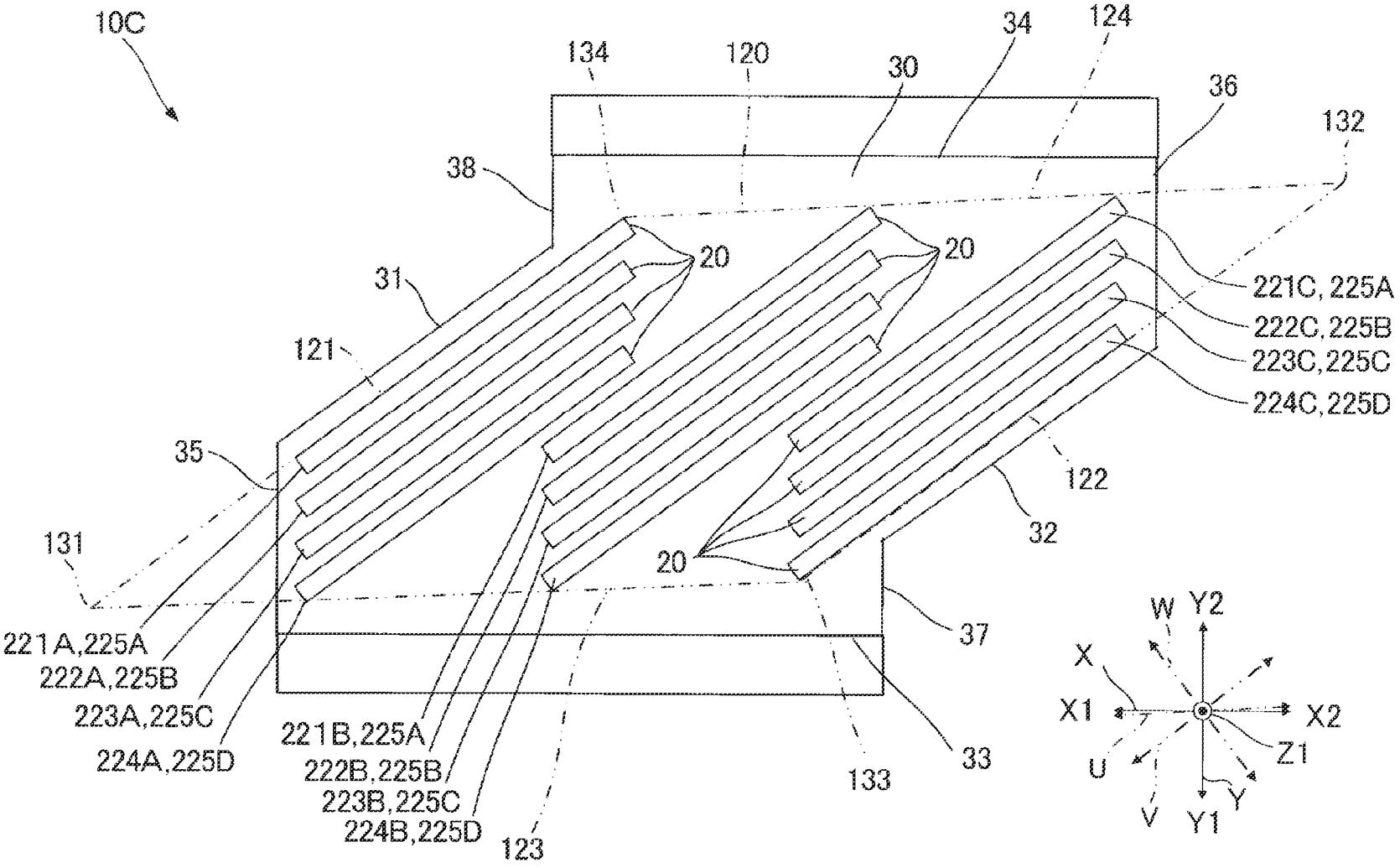
FIG. 19 is a bottom view showing an ejection surface of a liquid ejecting head according to a first modification example.

Next, a liquid ejecting head 10C according to a first modification example will be described with reference to FIG. 19. FIG. 19 is a bottom view showing an ejection surface of the liquid ejecting head according to the first modification example. In the description of the liquid ejecting head 10C, the same description as the above-mentioned liquid ejecting head 10 will be omitted. The liquid ejecting head 10C according to the first modification example is different from the liquid ejecting head 10 described above in the number and arrangement of the head chips 20. The liquid ejecting head 10C includes an ejection surface 30 having a shape different from that of the ejection surface 30 of the liquid ejecting head 10. The shape of the virtual parallelogram 120 of the liquid ejecting head 10C is different from the shape of the virtual parallelogram 120 of the liquid ejecting head 10.

The liquid ejecting head 10C includes a plurality of head chips 20 extending in a V direction. The V direction may be different from or the same as the V direction in the liquid ejecting head 10. The liquid ejecting head 10C includes a plurality of chip groups 225A to 225D. The plurality of chip groups 225A to 225D are arranged in this order in the Y1 direction.

The chip group 225A has head chips 221A, 221B, and 221C as a plurality of head chips 20. The head chips 221A, 221B, and 221C are arranged in this order in the X2 direction. The head chip 221A is inscribed in the edge 31.

The chip group 225B has head chips 222A, 222B, and 222C as a plurality of head chips 20. The head chips 222A, 222B, and 222C are arranged in this order in the X2 direction.

The chip group 225C has head chips 223A, 223B, and 223C, as a plurality of head chips 20. The head chips 223A, 223B, and 223C are arranged in order in the X2 direction.

The chip group 225D has head chips 224A, 224B, and 224C as a plurality of head chips 20. The head chips 224A, 224B, and 224C are arranged in order in the X2 direction. The head chip 224C is inscribed in the edge 32.

Next, the virtual parallelogram 120 corresponding to the arrangement of the head chips 20 of the liquid ejecting head 10C will be described. All head chips 20 are present inside the virtual parallelogram 120. The head chip 221A is inscribed in the virtual side 121. The head chip 224C is inscribed in the virtual side 122. The head chips 224A, 22B, and 224C are inscribed in the virtual side 123. The head chips 221A, 221B, and 221C are inscribed in the virtual side 124. Among the plurality of head chips 20, there may be a head chip 20 that is not in contact with the virtual parallelogram 120.

Even in the liquid ejecting head 10C, the ejection surface 30 is not overlapped with the acute-angled portions 131 and 132, as in the liquid ejecting head 10. The ejection surface 30 is overlapped with the entire regions of both obtuse-angled portions 133 and 134 of the virtual parallelogram 120. Only one head chip 221A is inscribed in the virtual side 121. The plurality of head chips 20 include the head chip 221A inscribed in the virtual side 121 at a position closest to the acute-angled portion 131, and the head chip 222A inscribed in the virtual side 123 at a position closest to the acute-angled portion 131. The head chip 221A is an example of the first head chip, and the head chip 224A is an example of the second head chip.

The edge 35 of the liquid ejecting head 10C extends in the Y-axis direction between the acute-angled portion 131 and the head chip 224A in the X-axis direction. The edge 35 of the liquid ejecting head 10C is an example of the first edge. The edge 35 is overlapped with the head chips 221A, 222A, 223A that are not in contact with the virtual side 123 when viewed in the X-axis direction. The edge 35 is overlapped with the head chip 221A that is in contact with the virtual side 124 when viewed in the X-axis direction.

The edge 37 of the liquid ejecting head 10C is disposed outside the obtuse-angled portion 133 in the X-axis direction, similarly to the edge 37 of the liquid ejecting head 10. The edge 37 of the liquid ejecting head 10C is an example of the second edge.

The liquid ejecting head 10C provided with the ejection surface 30 has the same effect as that of the liquid ejecting head 10 according to the first embodiment. The length of the ejection surface 30 in the X-axis direction is shorter than the length of the virtual parallelogram 120 in the X-axis direction. In the liquid ejecting head 10C described above, the length in the X-axis direction can be shortened as compared with the case of having the same structure as the outer shape of the virtual parallelogram 120.

Figure 20:
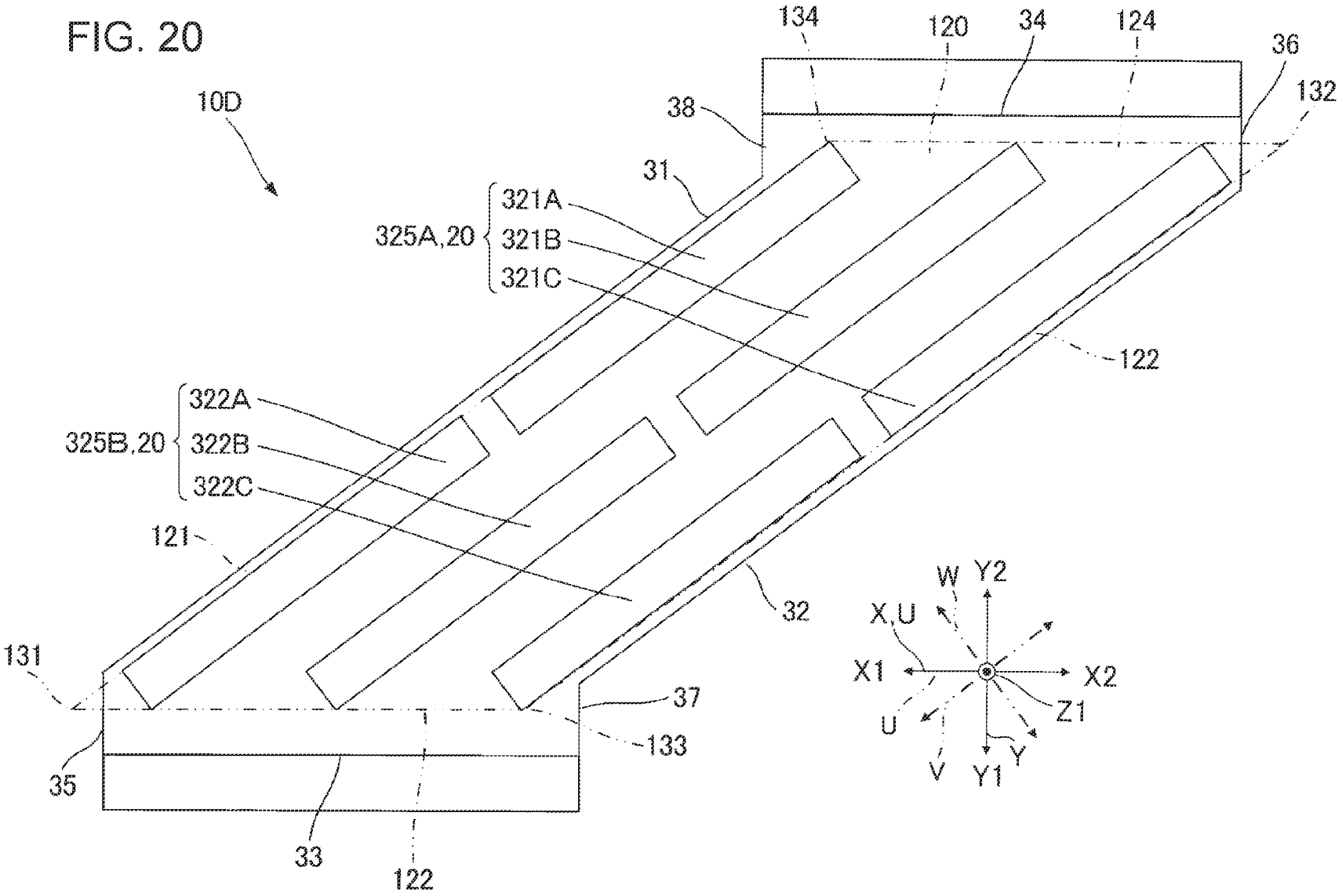
FIG. 20 is a bottom view showing an ejection surface of a liquid ejecting head according to a second modification example.

Next, a liquid ejecting head 10D according to a second modification example will be described with reference to FIG. 20. FIG. 20 is a bottom view showing the ejection surface of the liquid ejecting head according to the second modification example. In the description of the liquid ejecting head 10D, the same description as the above-mentioned liquid ejecting head 10 will be omitted. The liquid ejecting head 10D according to the first modification example is different from the liquid ejecting head 10 described above in the number and arrangement of the head chips 20. The liquid ejecting head 10D includes an ejection surface 30 having a shape different from that of the ejection surface 30 of the liquid ejecting head 10. The shape of the virtual parallelogram 120 of the liquid ejecting head 10D is different from the shape of the virtual parallelogram 120 of the liquid ejecting head 10.

The liquid ejecting head 10D includes a plurality of head chips 20 extending in a V direction. The V direction may be different from or the same as the V direction in the liquid ejecting head 10. The liquid ejecting head 10D includes a plurality of chip groups 325A and 325B. The plurality of chip groups 325A and 325B are arranged in this order in the Y1 direction.

The chip group 325A has head chips 321A, 321B, and 321C as a plurality of head chips 20. The head chips 321A, 321B, and 321C are arranged in this order in the X2 direction. The head chip 321A is inscribed in the virtual side 121. The head chip 321B is inscribed in the virtual side 122.

The chip group 325B has head chips 322A, 322B, and 322C as a plurality of head chips 20. The head chips 322A, 322B, and 322C are arranged in this order in the X2 direction. The head chip 322A is inscribed in the virtual side 121. The head chip 322C is inscribed in the virtual side 122.

The head chips 321A and 322A are arranged in the longitudinal direction thereof. The head chips 321B and 322B are arranged in the longitudinal direction thereof. The head chips 321C and 322C are arranged in the longitudinal direction thereof.

Even in the liquid ejecting head 10D, the ejection surface 30 is not overlapped with the acute-angled portions 131 and 132, as in the liquid ejecting head 10. The ejection surface 30 is overlapped with the entire regions of both obtuse-angled portions 133 and 134 of the virtual parallelogram 120. Two head chips 321A and 322A are inscribed in the virtual side 121. The head chip 322A closest to the acute-angled portion 131 is in contact with both the virtual side 121 and the virtual side 123.

The edge 35 of the liquid ejecting head 10D extends in the Y-axis direction between the acute-angled portion 131 and the head chip 322A in the X-axis direction. The edge 35 of the liquid ejecting head 10D is an example of the first edge. The edge 35 is overlapped with the head chip 322A that is in contact with the virtual side 123 when viewed in the X-axis direction. The edge 35 is not overlapped with the head chip 321A that is in contact with the virtual side 124 when viewed in the X-axis direction.

The edge 37 of the liquid ejecting head 10D is disposed outside the obtuse-angled portion 133 in the X-axis direction, similarly to the edge 37 of the liquid ejecting head 10. The edge 37 of the liquid ejecting head 10C is an example of the second edge.

The liquid ejecting head 10D provided with the ejection surface 30 has the same effect as that of the liquid ejecting head 10 according to the first embodiment. The length of the ejection surface 30 in the X-axis direction is shorter than the length of the virtual parallelogram 120 in the X-axis direction. In the liquid ejecting head 10D described above, the length in the X-axis direction can be shortened as compared with the case of having the same structure as the outer shape of the virtual parallelogram 120.

Figure 21:
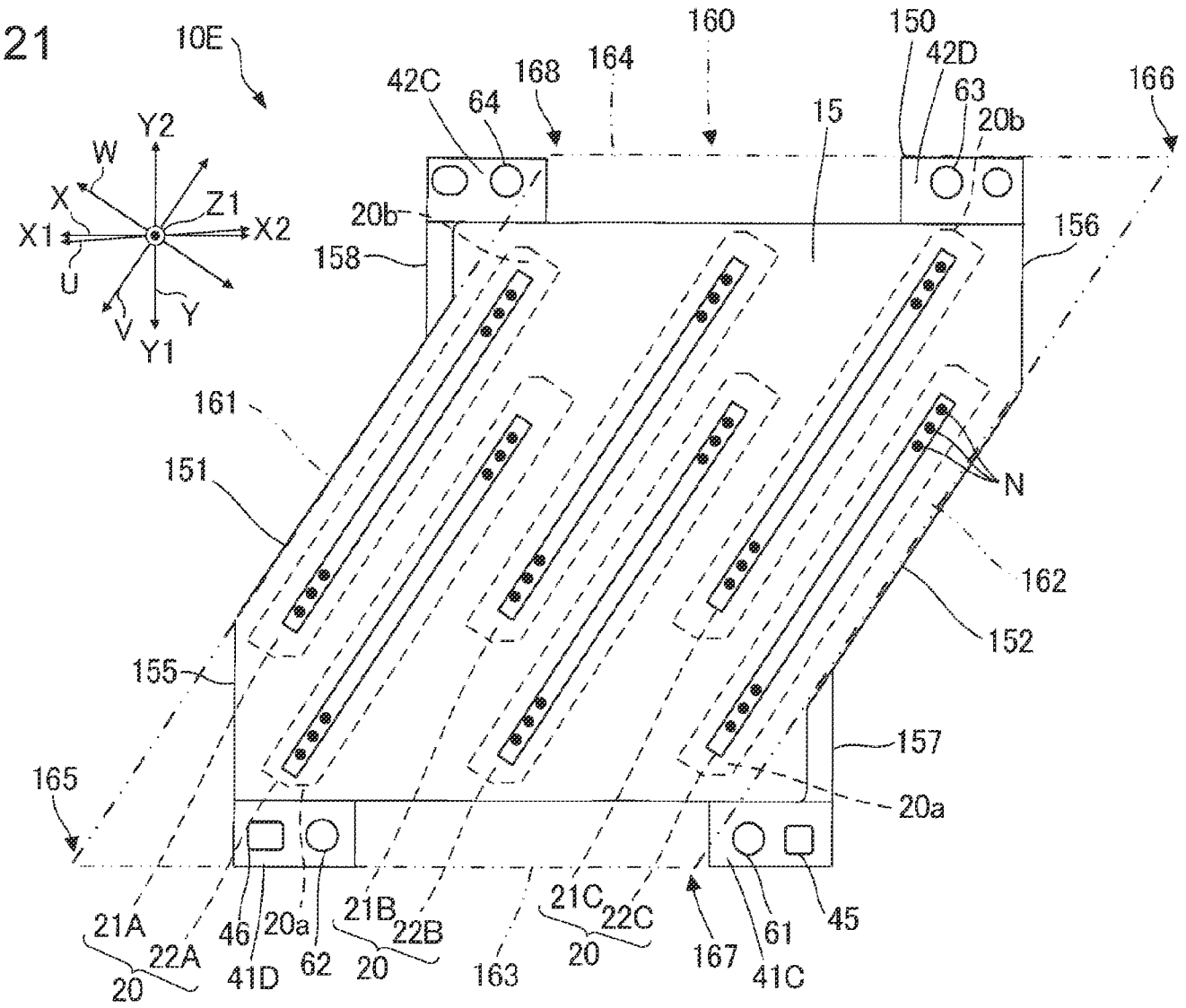
FIG. 21 is a bottom view showing an ejection surface of a liquid ejecting head according to a third modification example.

Next, a liquid ejecting head 10E according to a third modification example will be described with reference to FIG. 21. FIG. 21 is a bottom view showing the ejection surface 30 of the liquid ejecting head 10E according to the third modification example. The liquid ejecting head 10E according to the third modification example is different from the liquid ejecting head 10 according to the first embodiment in that it includes flange portions 41C, 41D, 42C, and 42D having a configuration different from that of the flange portions 41 and 42. In the description of the liquid ejecting head 10E, the same description as that of the liquid ejecting head 10 according to the first embodiment will be omitted.

In the holder 13 of the liquid ejecting head 10E, flange portions 41C, 41D, 42C, and 42D projecting in the Y-axis direction are formed. The flange portions 41C and 41D project in the Y1 direction, and the flange portions 42C and 42D project in the Y2 direction.

The flange portions 41C and 41D are separated from each other in the X-axis direction. A notch is formed between the flange portions 41C and 41D in the X-axis direction. The flange portion 41C is positioned in the X2 direction with respect to the flange portion 41D. The positioning portion 45 and the screw hole 61 are formed in the flange portion 41C. The positioning portion 46 and the screw hole 62 are formed in the flange portion 41D.

The flange portions 42C and 42D are separated from each other in the X-axis direction. A notch is formed between the flange portions 42C and 42D in the X-axis direction. The flange portion 42C is positioned in the X1 direction with respect to the flange portion 42D. The positioning portion 45 and the screw hole 61 are formed in the flange portion 42C. The screw hole 63 is formed in the flange portion 42D.

Even the liquid ejecting head 10E has the same effect as that of the liquid ejecting head 10 according to the first embodiment.

Figure 22:
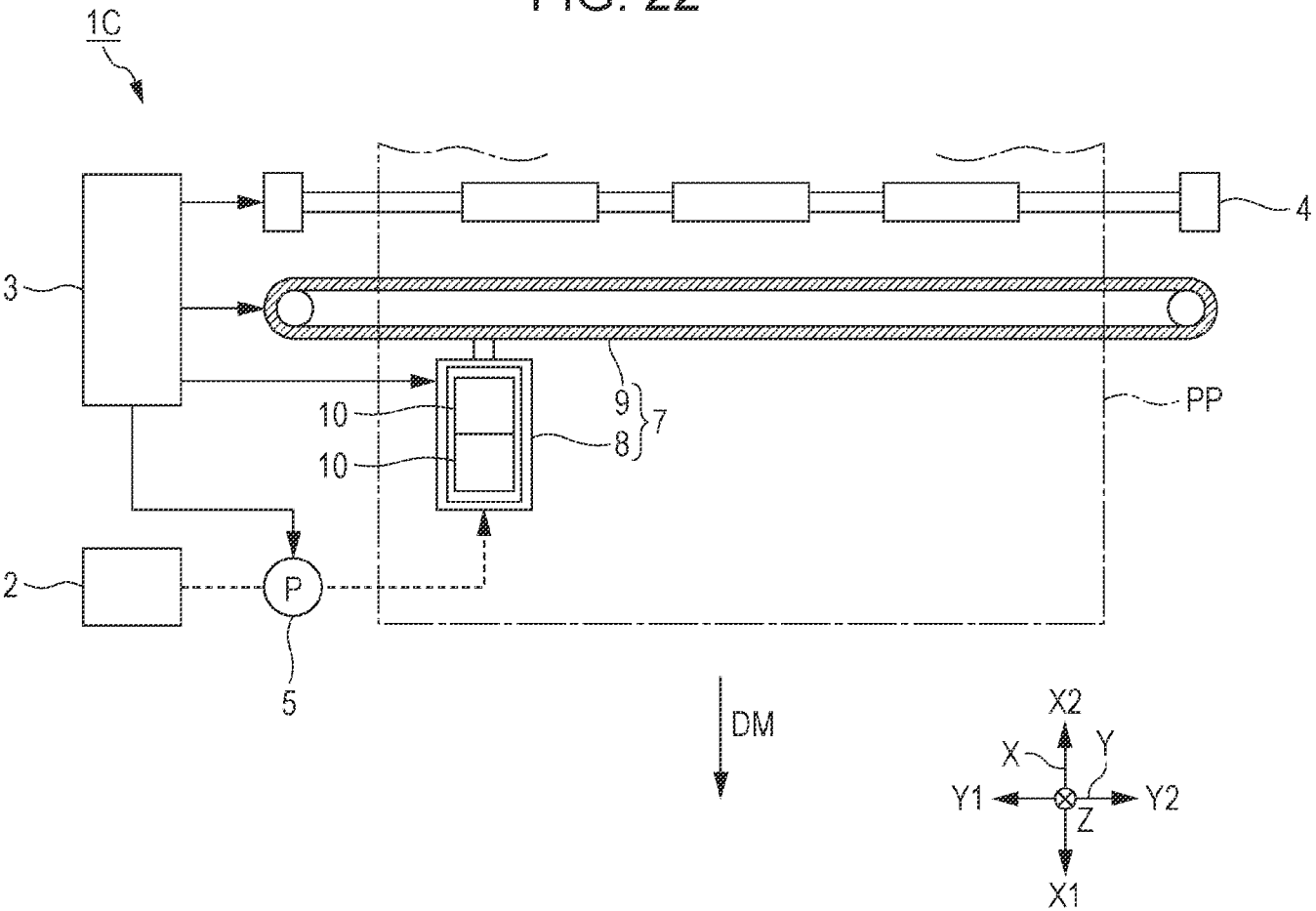
FIG. 22 is a schematic view showing a liquid ejecting apparatus according to a third embodiment.

Next, a liquid ejecting apparatus 1C according to a third embodiment will be described with reference to FIG. 22. FIG. 22 is a schematic view showing the liquid ejecting apparatus 1C according to the third embodiment. The liquid ejecting apparatus 1C according to the third embodiment shown in FIG. 22 is a serial type printing apparatus. The liquid ejecting apparatus 1C includes a plurality of liquid ejecting heads 10 arranged in the transport direction DM of the medium PP. The plurality of liquid ejecting heads 10 are arranged in the X-axis direction. In the description of the liquid ejecting apparatus 1C according to the third embodiment, the same description as that of the liquid ejecting apparatus 1A of the first embodiment will be omitted.

The liquid ejecting apparatus 1C includes a head transport mechanism 7. The head transport mechanism 7 has a carriage 8 and an endless belt 9. The carriage 8 holds a plurality of liquid ejecting heads 10. The carriage 8 is coupled to the endless belt 9. The carriage 8 is transported by the endless belt 9 and reciprocates in a main scanning direction.

When executing the printing process, the liquid ejecting apparatus 1C transports the medium PP in a sub-scanning direction intersecting the main scanning direction and ejects ink from the liquid ejecting heads 10 while reciprocating the liquid ejecting head 10 in the main scanning direction. As a result, dots corresponding to the print data are formed on the medium PP.

The liquid ejecting head 10 can also be applied to the liquid ejecting apparatus 1C, which is a serial type printer.

It should be noted that the above-described embodiment merely shows a typical embodiment of the present disclosure, and the present disclosure is not limited to the above-mentioned embodiment, and various modifications and additions can be made without departing from the spirit of the present disclosure.

For the liquid ejecting apparatus 1A illustrated in the above-described embodiment, for example, as shown in FIG. 10, in the adjacent liquid ejecting head 10, the width W11 of the gap between the edge 37 of one liquid ejecting head 10 and the edge 35 of the other liquid ejecting head 10 is wider than the width W12 of the gap between the holders 13, but the width W11 and the width W12 may be the same. In other words, the length L37 of the edge 37 of the liquid ejecting head 10 may be the same as the length L35 of the edge 35. Similarly, by making the length of the edge 38 of the liquid ejecting head 10 the same as the length of the edge 36, the width of the gap between the edge 38 of one liquid ejecting head 10 and the edge 36 of the other liquid ejecting head 10 may be the same as the width W12 of the gap between the holders 13. In this case, the wall surface 13*a* defining the edge 37 may be disposed at the same position in the X-axis direction as the wall surface 13*b* defining the edge 157 of the holder 13. In other words, the wall surface 13*a* and the wall surface 13*b* may be flush with each other.

The liquid ejecting apparatus 1A illustrated in the above-described embodiment can be employed in various devices such as a facsimile machine and a copier, in addition to a device dedicated to printing. However, the application of the liquid ejecting apparatus 1A is not limited to printing. For example, the liquid ejecting apparatus for ejecting a solution of a coloring material is used as a manufacturing device for forming a color filter of a display device such as a liquid crystal display panel. Further, the liquid ejecting apparatus for ejecting a solution of a conductive material is used as a manufacturing device for forming wiring or electrodes on a wiring substrate. Further, a liquid ejecting apparatus for ejecting a solution of an organic substance related to a living body is used, for example, as a manufacturing device for manufacturing a biochip.

What is claimed is:

1. A liquid ejecting head that has an ejection surface configured to eject a liquid, the liquid ejecting head comprising:

a plurality of head chips that are long in a first direction, wherein the plurality of head chips are arranged inside a virtual parallelogram including a first virtual side, a second virtual side, a third virtual side and a fourth virtual side, the first virtual side and the second virtual side that are respectively in contact with at least one of the plurality of head chips and that extend in the first direction, the third virtual side and the fourth virtual side that are respectively in contact with at least one of the plurality of head chips and that in a second direction intersecting the first direction, the first direction is a direction inclined with respect to a transport direction of a medium on which a liquid is ejected when the ejection surface is viewed in the normal direction of the ejection surface, the ejection surface has a third edge extending in the first direction, the ejection surface is not overlapped with acute-angled portions of the virtual parallelogram when the ejection surface is viewed in a normal direction of the ejection surface, the first virtual side and the third virtual side form a first acute-angled portion that is one of the acute-angled portions, the plurality of head chips include:

a first head chip inscribed in the first virtual side at a position closest to the first acute-angled portion; and a second head chip inscribed in the third virtual side at a position closest to the first acute-angled portion, the second head chip and the first head chip being different from each other, and the ejection surface has a first edge intersecting the first virtual side and the third virtual side and located between the head chip closest to the first acute-angled portion and the first acute-angled portion with respect to a third direction orthogonal to the transport direction.

2. The liquid ejecting head according to claim 1, wherein the head chip has a nozzle plate provided with a plurality of nozzles, and the head chip has a substantially rectangular shape when the ejection surface is viewed in the normal direction of the ejection surface.

3. The liquid ejecting head according to claim 1, wherein the ejection surface is overlapped with an entire region of both obtuse-angled portions of the virtual parallelogram when the ejection surface is viewed in the normal direction of the ejection surface.

4. The liquid ejecting head according to claim 1, wherein only one head chip is inscribed in the first virtual side.

5. The liquid ejecting head according to claim 1, wherein a plurality of the liquid ejecting heads are arranged in the third direction to form a line head, and the first direction is a direction inclined with respect to the third direction when the ejection surface is viewed in the normal direction of the ejection surface.

6. The liquid ejecting head according to claim 1, wherein the first edge extends linearly in a fourth direction intersecting the third direction.

7. The liquid ejecting head according to claim 6, wherein the ejection surface has a second edge that is an opposite side to the first edge in the third direction and extends in the fourth direction, and the second edge is not overlapped with the virtual parallelogram when the ejection surface is viewed in the normal direction of the ejection surface.

8. The liquid ejecting head according to claim 7, wherein a length of the first edge in the fourth direction is longer than a length of the second edge in the fourth direction.

9. The liquid ejecting head according to claim 6, wherein the plurality of head chips constitute:

a first chip group, including one or more head chips of the plurality head chips, that is arranged in the third direction; and a second chip group, including one or more head chips of the plurality head chips, that is arranged in the third direction, and the first chip group and the second chip group are arranged in the transport direction.

10. The liquid ejecting head according to claim 1, wherein the first edge is overlapped with at least one of the plurality of head chips that are not in contact with the third virtual side when viewed in the third direction.

11. The liquid ejecting head according to claim 10, wherein the first edge is overlapped with at least one of the plurality of head chips that are in contact with the fourth virtual side when viewed in the third direction.

12. The liquid ejecting head according to claim 11, wherein the plurality of head chips constitute:

a first chip group, including one or more head chips of the plurality head chips, that is arranged in the third direction; and a second chip group, including one or more head chips of the plurality head chips, that is arranged in the third direction, and the first chip group and the second chip group are arranged in the fourth direction.

13. The liquid ejecting head according to claim 10, wherein the plurality of head chips constitute:

a first chip group, including one or more head chips of the plurality head chips, that is arranged in the third direction; and a second chip group, including one or more head chips of the plurality head chips, that is arranged in the third direction, and the first chip group and the second chip group are arranged in the fourth direction.

14. The liquid ejecting head according to claim 1, wherein each of the plurality of head chips is inscribed in the virtual parallelogram.

15. A liquid ejecting apparatus comprising:

the liquid ejecting head according to claim 1; and a liquid storage portion that stores a liquid supplied to the liquid ejecting head.

16. The liquid ejecting head according to claim 1, wherein the plurality of head chips constitute:

a first chip group, including one or more head chips of the plurality head chips, that is arranged in the third direction; and a second chip group, including one or more head chips of the plurality head chips, that is arranged in the third direction, and the first chip group and the second chip group are arranged in the transport direction.

17. The liquid ejecting head according to claim 16, wherein the first chip group and the second chip group substantially overlap each other when viewed in the transport direction.

18. A liquid ejecting head that has an ejection surface configured to eject a liquid, the liquid ejecting head comprising:

a plurality of head chips that are long in a first direction, wherein the plurality of head chips are arranged inside a virtual parallelogram including a first virtual side, a second virtual side, a third virtual side and a fourth virtual side, the first virtual side and the second virtual side that are respectively in contact with at least one of the plurality of head chips and that extend in the first direction, the third virtual side and the fourth virtual side that are respectively in contact with at least one of the plurality of head chips and that in a second direction intersecting the first direction, the first direction is a direction inclined with respect to a transport direction of a medium on which a liquid is ejected when the ejection surface is viewed in the normal direction of the ejection surface, the ejection surface has a third edge extending in the first direction, the ejection surface is not overlapped with acute-angled portions of the virtual parallelogram when the ejection surface is viewed in a normal direction of the ejection surface, the plurality of head chips constitute:

a first chip group, including one or more head chips of the plurality head chips, is arranged in the third direction; and a second chip group, including one or more head chips of the plurality head chips, is arranged in the third direction, and the first chip group and the second chip group are arranged in the transport direction, the first virtual side and the third virtual side form a first acute-angled portion that is one of the acute-angled portions, and the ejection surface has a first edge located between the head chip closest to the first acute-angled portion and the first acute-angled portion with respect to the third direction.

19. The liquid ejecting head according to claim 18, wherein the first chip group and the second chip group substantially overlap each other when viewed in the transport direction.

20. The liquid ejecting head according to claim 18, wherein the first edge and the third edge are in contact with each other.

* * * * *